US009451815B1

(12) United States Patent
Murray

(10) Patent No.: US 9,451,815 B1
(45) Date of Patent: Sep. 27, 2016

(54) APPLICATOR MOUNTING APPARATUS AND A METHOD OF USING THE SAME

(71) Applicant: William C. Murray, Huron, OH (US)

(72) Inventor: William C. Murray, Huron, OH (US)

( * ) Notice: Subject to any disclaimer, the term of this patent is extended or adjusted under 35 U.S.C. 154(b) by 72 days.

(21) Appl. No.: 14/597,197

(22) Filed: Jan. 14, 2015

Related U.S. Application Data

(60) Provisional application No. 61/927,512, filed on Jan. 15, 2014.

(51) Int. Cl.

| | |
|---|---|
| ***A45F 5/00*** | (2006.01) |
| ***A45D 40/00*** | (2006.01) |
| ***A45C 11/00*** | (2006.01) |
| ***A45D 40/18*** | (2006.01) |

(52) U.S. Cl.
CPC ..... *A45C 11/00* (2013.01); *A45D 40/18* (2013.01); *A45D 40/00* (2013.01); *A45D 2040/0006* (2013.01); *A45F 5/00* (2013.01)

(58) Field of Classification Search
CPC A45F 5/00; A45D 2040/0006; A45D 40/00; A45D 40/18
USPC ..... 224/181, 251, 901.8; D3/205; 401/131
See application file for complete search history.

(56) References Cited

U.S. PATENT DOCUMENTS

| | | | | | |
|---|---|---|---|---|---|
| 1,714,877 | A | * | 5/1929 | Kaufman | A24F 15/12 206/101 |
| D125,152 | S | * | 2/1941 | Hahn | 206/766 |
| 2,441,017 | A | * | 5/1948 | Garrett | A45D 40/02 132/316 |
| 2,637,440 | A | * | 5/1953 | Lodewick | A45D 40/18 220/315 |
| D229,119 | S | * | 11/1973 | Litton | D28/76 |
| 4,090,185 | A | | 5/1978 | Patty | |
| 4,168,129 | A | * | 9/1979 | Herrnring | B43K 23/126 220/230 |
| 4,325,504 | A | | 4/1982 | Amani | |
| D311,260 | S | | 10/1990 | Hasert | |
| 5,067,836 | A | * | 11/1991 | Khan | A45D 40/06 401/195 |
| D335,364 | S | * | 5/1993 | Yang | D28/85 |
| D347,297 | S | * | 5/1994 | Vesco | D28/73 |
| D361,507 | S | * | 8/1995 | Langemann | D3/201 |
| D377,543 | S | * | 1/1997 | Hanson | D28/73 |
| D391,681 | S | * | 3/1998 | Huang | D28/85 |
| 5,893,496 | A | | 4/1999 | Katz et al. | |
| D433,562 | S | * | 11/2000 | Redlinger | D3/208 |
| 6,283,658 | B1 | * | 9/2001 | Estevez | A45D 40/04 401/192 |
| 6,308,876 | B1 | * | 10/2001 | Havens | A01M 31/004 224/222 |
| 6,382,481 | B1 | * | 5/2002 | McIlmoil | F23Q 2/32 224/162 |
| 6,394,677 | B2 | * | 5/2002 | Wang | B43K 23/02 224/183 |
| 6,616,294 | B1 | * | 9/2003 | Henry | A42B 3/04 2/422 |
| 6,792,619 | B1 | * | 9/2004 | Morris | A42B 1/247 2/10 |

(Continued)

FOREIGN PATENT DOCUMENTS

| | | |
|---|---|---|
| EP | 1647200 A2 | 4/2006 |

*Primary Examiner* — Justin Larson
(74) *Attorney, Agent, or Firm* — The Law Office of Patrick F. O'Reilly III, LLC

(57) ABSTRACT

An applicator mounting apparatus for supporting an applicator from a mounting surface is disclosed herein. The applicator mounting apparatus includes a housing defining an applicator cavity for receiving at least a portion of an applicator therein; a mount engaging with the housing to contain the applicator, the mount configured to be coupled to a mounting surface, a portion of the mount configured to serve as a cap for the applicator; and at least one coupling device releasably coupling the housing to the mount. An applicator system and a method of using an applicator mounting apparatus are also disclosed herein.

17 Claims, 21 Drawing Sheets

(56) References Cited

U.S. PATENT DOCUMENTS

| | | | | | |
|---|---|---|---|---|---|
| D528,290 | S | * | 9/2006 | Anderton | D28/77 |
| D532,714 | S | * | 11/2006 | Scharr | D11/79 |
| D563,096 | S | * | 3/2008 | Ivey | D3/205 |
| D598,608 | S | * | 8/2009 | Baumer | D28/77 |
| D630,010 | S | * | 1/2011 | Brown | D3/208 |
| D634,071 | S | * | 3/2011 | Briers | D28/66 |
| 7,918,620 | B2 | | 4/2011 | Del Ponte | |
| 8,136,686 | B2 | * | 3/2012 | Schlatter | A44B 15/005 220/212.5 |
| 8,235,262 | B1 | * | 8/2012 | Sakdol | A42B 3/04 224/183 |
| 8,444,337 | B2 | * | 5/2013 | Teller | A45D 40/00 206/385 |
| 8,556,527 | B1 | * | 10/2013 | Chou | A45C 13/1069 215/237 |
| 8,596,897 | B2 | * | 12/2013 | Cole | A45D 40/00 401/195 |
| D698,090 | S | | 1/2014 | Smith | |
| D698,497 | S | * | 1/2014 | Smith | D28/76 |
| D708,789 | S | * | 7/2014 | Schlatter | D28/87 |
| D713,712 | S | * | 9/2014 | Beversluis | D8/396 |
| D733,565 | S | * | 7/2015 | Leventhal | D28/83 |
| 2002/0179655 | A1 | * | 12/2002 | Finlay | A45F 5/00 224/182 |
| 2003/0047578 | A1 | | 3/2003 | Barnett | |
| 2004/0031829 | A1 | * | 2/2004 | Guimond | A45F 5/00 224/196 |
| 2004/0057578 | A1 | | 3/2004 | Brewer | |
| 2005/0279786 | A1 | * | 12/2005 | Gac | A42B 1/24 224/181 |
| 2007/0012736 | A1 | * | 1/2007 | Wagner | A45F 5/00 224/218 |
| 2007/0014624 | A1 | * | 1/2007 | Fogelson | A45D 40/18 401/131 |
| 2007/0031176 | A1 | * | 2/2007 | Gieux | A45D 40/20 401/50 |
| 2008/0054033 | A1 | * | 3/2008 | Synness | A42B 1/24 224/181 |
| 2008/0276348 | A1 | | 11/2008 | England et al. | |
| 2013/0341833 | A1 | * | 12/2013 | Teller | A45D 40/00 264/299 |
| 2014/0128132 | A1 | | 5/2014 | Cox, III | |

* cited by examiner

Section B-B

Section A-A

APPLICATOR MOUNTING APPARATUS AND A METHOD OF USING THE SAME

CROSS-REFERENCE TO RELATED APPLICATIONS

This patent application claims priority to, and incorporates by reference in its entirety, U.S. Provisional Patent Application No. 61/927,512, entitled "APPLICATOR MOUNTING APPARATUS", filed on Jan. 15, 2014.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The present disclosure relates to a holder and mounting device, and more particularly, to a holder and mounting device for retaining and releasably securing an applicator to a surface for accessible use.

2. Background

Often, a need for quick and easy access to a product such as lip balm is needed while performing various activities indoors and outdoors, especially when the activities occur in colder temperatures. For outdoor enthusiasts, such as skiers and snowboarders, lip balm is an essential product as the cold temperatures cause lips to become cracked, rough, or sore. Lip balm is typically available in various types of applicators such as applicators having a cap and dispensing means. However, using the applicator to access the lip balm while engaging in the outdoor activities can be cumbersome and time consuming as the process often requires removing gloves to use the applicator and accessing bags, containers, backpacks, or pockets to find the lip balm applicators. In addition, applicators are generally small and are easily lost, misplaced, or difficult to find in backpacks. Furthermore, the bags, containers, backpacks, and pockets can be unwieldy and do not provide the most secure method of retaining lip balm therein, especially during vigorous activities such as skiing and snowboarding.

In light of the above, there is a continuing need for a durable applicator mounting apparatus for containing an applicator (e.g., a lip balm applicator) that is uncomplicated to use, easily accessible, securely contained, light weight, and is inexpensive and easy to manufacture.

BRIEF SUMMARY OF EMBODIMENTS OF THE INVENTION

Accordingly, the present invention is directed to an applicator mounting apparatus and a method of using the same that substantially obviates one or more problems resulting from the limitations and deficiencies of the related art.

As described in the instant disclosure, an applicator mounting apparatus that is uncomplicated to use, easily accessible, securely contained, light weight, and is inexpensive and easy to manufacture has surprisingly been discovered.

In accordance with one or more embodiments of the present invention, there is provided an applicator mounting apparatus for supporting an applicator from a mounting surface. The applicator mounting apparatus includes a housing defining an applicator cavity for receiving at least a portion of an applicator therein; a mount engaging with the housing to contain the applicator, the mount configured to be coupled to a mounting surface, a portion of the mount configured to serve as a cap for the applicator; and at least one coupling device releasably coupling the housing to the mount.

In a further embodiment of the present invention, at least one surface of the housing comprises a textured gripping pattern, knurling, protrusions, or indentations for enhancing a grip of a user on the housing.

In yet a further embodiment, at least one surface of the housing comprises an aperture for enabling a user to gain access to a dispensing mechanism on the applicator without requiring the applicator to be removed from the housing.

In still a further embodiment, the mount further includes a support member and an engagement member extending in a cantilevered manner from the support member, the support member configured to couple the mount to the mounting surface, and the engagement member forming the portion of the mount that is configured to serve as a cap for the applicator.

In yet a further embodiment, the support member of the mount is configured to matingly engage with a portion of the housing.

In still a further embodiment, the portion of the housing with which the support member of the mount matingly engages is an elongate groove formed in a surface of the housing.

In yet a further embodiment, the engagement member of the mount comprises a cavity for receiving an end portion of the applicator, the cavity of the engagement member configured to substantially align with the applicator cavity of the housing when the housing is engaged with the mount.

In still a further embodiment, the engagement member of the mount comprises an interface surface, the interface surface of the engagement member configured to abut an end surface of the housing when the housing is engaged with the mount.

In yet a further embodiment, a side wall bounding the applicator cavity comprises a pointed tip for preventing an exposed end of a substance disposed in the applicator from contacting a front surface of the support member when the housing is engaged with the mount.

In still a further embodiment, the at least one coupling device comprises at least one pair of coupling devices, a first of the at least one pair of coupling devices being disposed in or on the housing, and a second of the at least one pair of coupling devices being disposed in or on the mount.

In yet a further embodiment, the at least one coupling device comprises one or more magnets.

In still a further embodiment, a side wall bounding the applicator cavity comprises an elongate slot formed therein so as to enable the wall to elastically deform when the applicator is inserted into the applicator cavity, the elongate slot being disposed along a length of the applicator cavity.

In yet a further embodiment, an interior surface of the side wall bounding the applicator cavity comprises an elongate protrusion disposed along a length of the applicator cavity for engaging a side of the applicator; and wherein an interior surface of an end wall bounding the applicator cavity comprises a conical projection for creating a gap between a dispensing mechanism of the applicator and the end wall of the applicator cavity so as to enable an uninhibited rotation of the dispensing mechanism.

In accordance with one or more other embodiments of the present invention, there is provided an applicator system configured to be supported from a mounting surface. The applicator system includes an applicator configured to dispense a substance for application on a body portion of a user or on an object, and an applicator mounting apparatus. The applicator mounting apparatus includes a housing defining an applicator cavity for receiving at least a portion of the applicator therein; a mount engaging with the housing to contain the applicator, the mount configured to be coupled to a mounting surface, a portion of the mount configured to serve as a cap for the applicator; and at least one coupling device releasably coupling the housing to the mount.

In a further embodiment of the present invention, the substance that is configured to be dispensed by the applicator comprises one of: (i) lip balm, (ii) lip gloss, (iii) sunblock or sunscreen, (iv) deodorant, (v) hair spray, (vi) perfume, (vii) insect repellant, and (viii) glue stick.

In yet a further embodiment, the mount of the applicator mounting apparatus further includes a support member and an engagement member extending in a cantilevered manner from the support member, the support member configured to couple the mount to the mounting surface, and the engagement member forming the portion of the mount that is configured to serve as a cap for the applicator.

In still a further embodiment, the engagement member of the mount comprises a cavity for receiving an end portion of the applicator, the cavity of the engagement member configured to substantially align with the applicator cavity of the housing when the housing is engaged with the mount.

In yet a further embodiment, the at least one coupling device of the applicator mounting apparatus comprises at least one pair of coupling devices, a first of the at least one pair of coupling devices being disposed adjacent to the applicator cavity of the housing, and a second of the at least one pair of coupling devices being disposed adjacent to the cavity of the engagement member of the mount.

In accordance with yet one or more other embodiments of the present invention, there is provided a method of using an applicator mounting apparatus. The method comprises the steps of: (i) providing an applicator configured to dispense a substance for application on a body portion of a user or on an object, the applicator comprising an applicator body portion and an applicator cap removably engaged with the applicator body portion; (ii) providing an applicator mounting apparatus for supporting the applicator from a mounting surface, the applicator mounting apparatus including a housing defining an applicator cavity for receiving at least a portion of the applicator therein; a mount engaging with the housing to contain the applicator, the mount configured to be coupled to the mounting surface, a portion of the mount configured to serve as a cap for the applicator; and at least one coupling device releasably coupling the housing to the mount; (iii) attaching the mount of the applicator mounting apparatus to the mounting surface; (iv) inserting the applicator body portion of the applicator into the applicator cavity of the housing of the applicator mounting apparatus; (v) removing the applicator cap from the applicator body portion of the applicator so as to expose an end portion of the applicator; and (vi) engaging the housing of the applicator mounting apparatus with the mount of the applicator mounting apparatus such that the portion of the mount serves as a cap for the end portion of the applicator.

In a further embodiment of the present invention, the mount of the applicator mounting apparatus further comprises a cavity for receiving the end portion of the applicator, the cavity of the mount configured to substantially align with the applicator cavity of the housing when the housing is engaged with the mount. Also, in this further embodiment, the step of (vi) engaging the housing of the applicator mounting apparatus with the mount further comprises inserting the end portion of the applicator into the cavity of the mount so as to cover the end portion of the applicator.

It is to be understood that the foregoing general description and the following detailed description of the present invention are merely exemplary and explanatory in nature. As such, the foregoing general description and the following detailed description of the invention should not be construed to limit the scope of the appended claims in any sense.

Further areas of applicability for the applicator mounting apparatus will become apparent from the description provided herein.

BRIEF DESCRIPTION OF THE SEVERAL VIEWS OF THE DRAWINGS

The invention will now be described, by way of example, with reference to the accompanying drawings, in which.

Figure 1:
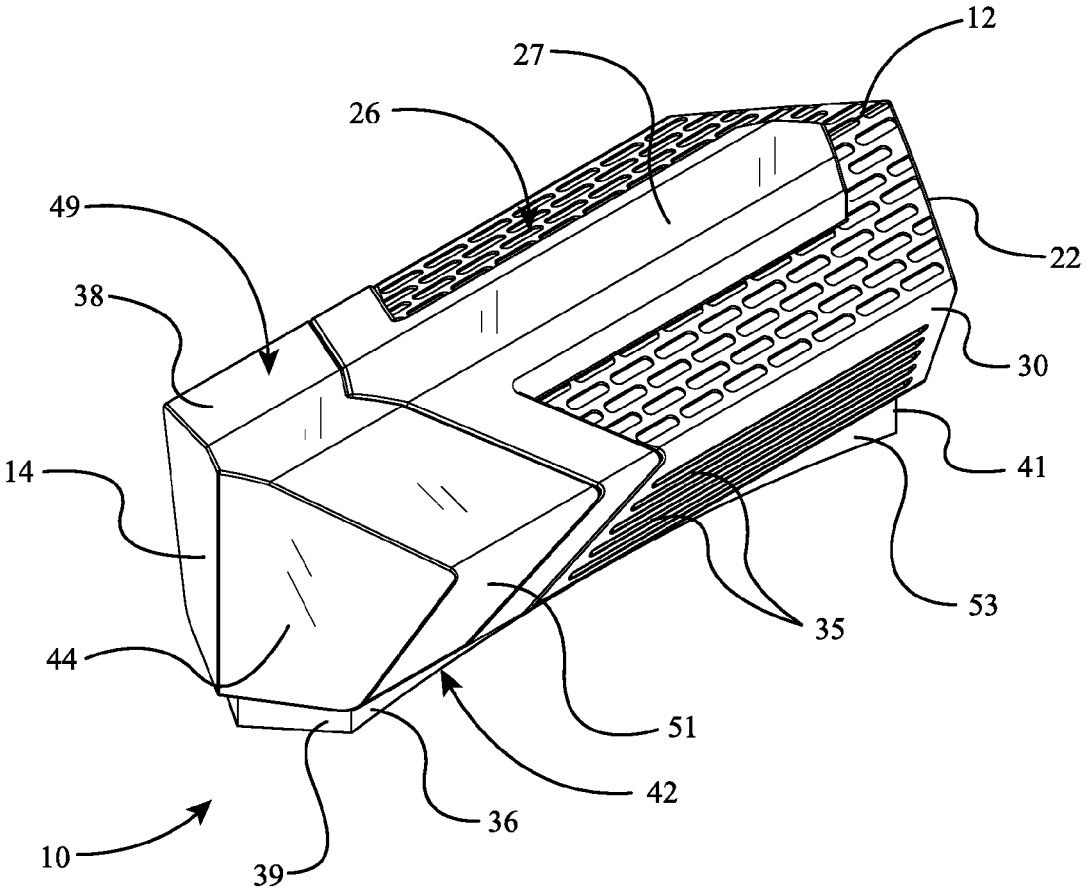
FIG. 1 is a front-end perspective view of the applicator mounting apparatus, according to one embodiment of the invention.
Figure 2:
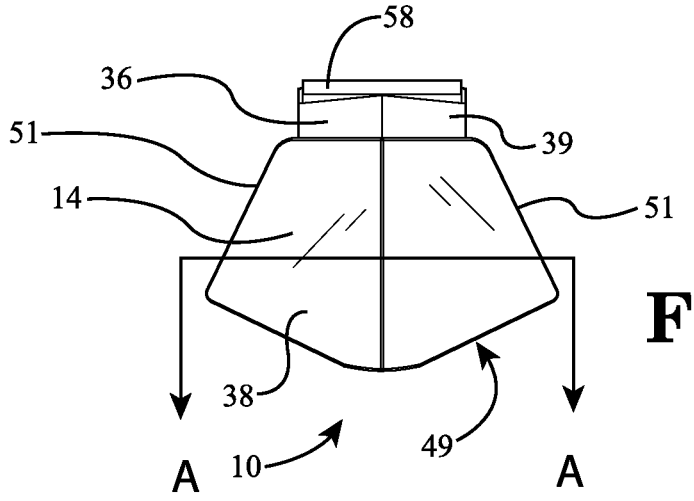
FIG. 2 is a top plan view of the applicator mounting apparatus of FIG. 1.
Figure 3:
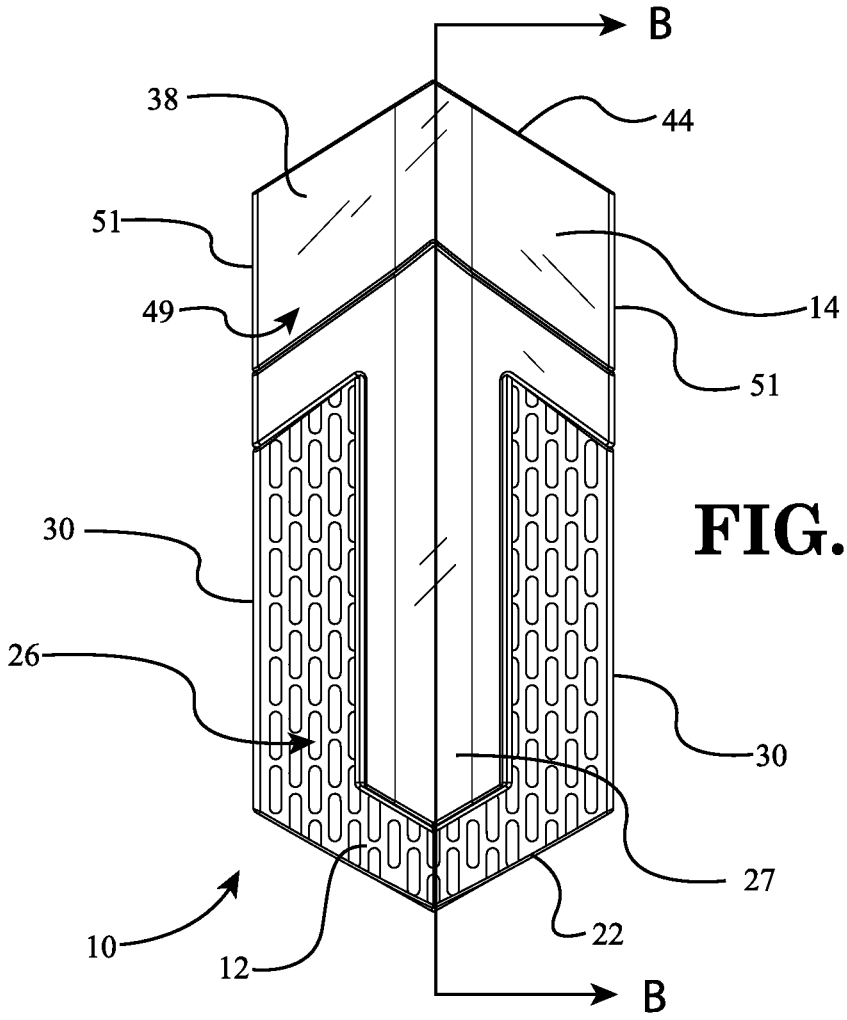
FIG. 3 is a front elevational view of the applicator mounting apparatus of FIG. 1.
Figure 4:
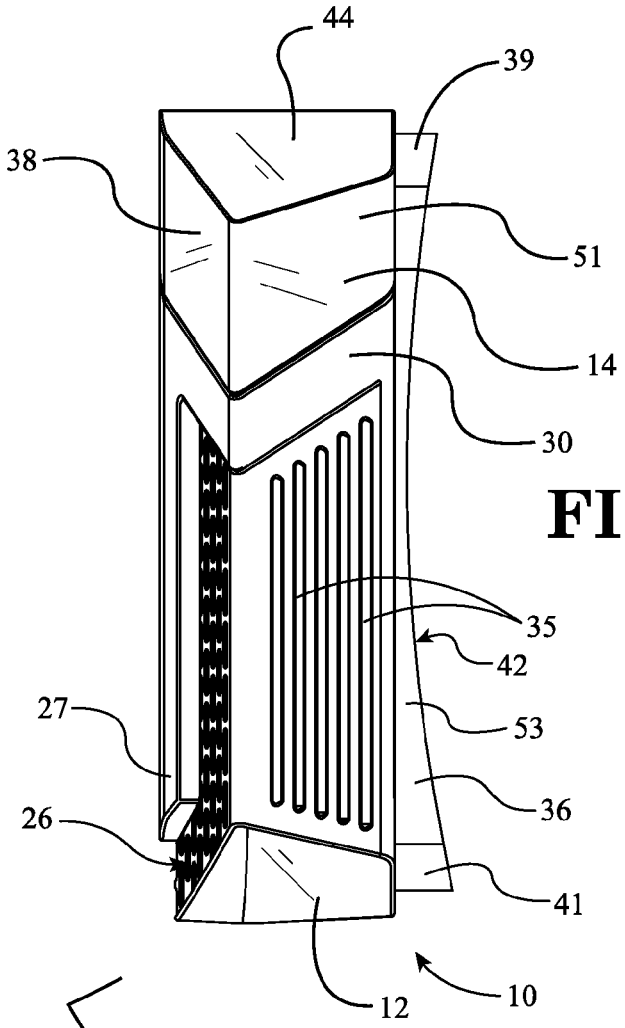
FIG. 4 is a side elevational view of the applicator mounting apparatus of FIG. 1.

Throughout the figures, the same parts are always denoted using the same reference characters so that, as a general rule, they will only be described once. All references to direction and position, unless otherwise indicated, refer to the orientations of the applicator mounting apparatus illustrated in the drawings.

DETAILED DESCRIPTION OF EMBODIMENTS OF THE INVENTION

The following description is merely exemplary in nature and is not intended to limit the present disclosure, application, or uses.

Referring to FIGS. 1-25, there is illustrated an applicator mounting apparatus 10 according to one embodiment of the invention. The applicator mounting apparatus 10 is configured to contain an applicator 100 therein and configured to mount to a surface (e.g., a surface 210 of a helmet—see FIG. 5). As shown in FIGS. 1-6, the applicator mounting apparatus 10 includes a housing 12 configured to retain at least a portion of the applicator 100 and a mount 14 configured to engage the housing 12 and attach to the surface. The housing 12 is in releasable engagement with the mount 14.

Figure 7:
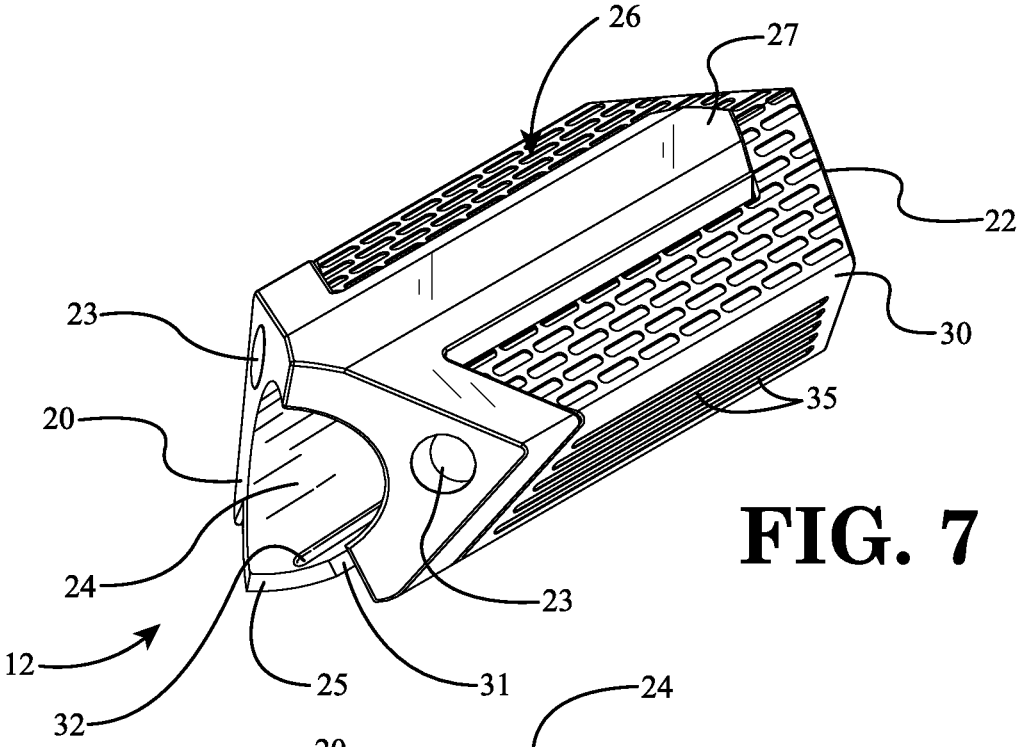
FIG. 7 is a front-end perspective view of the housing of the applicator mounting apparatus of FIG. 1.
Figure 8:
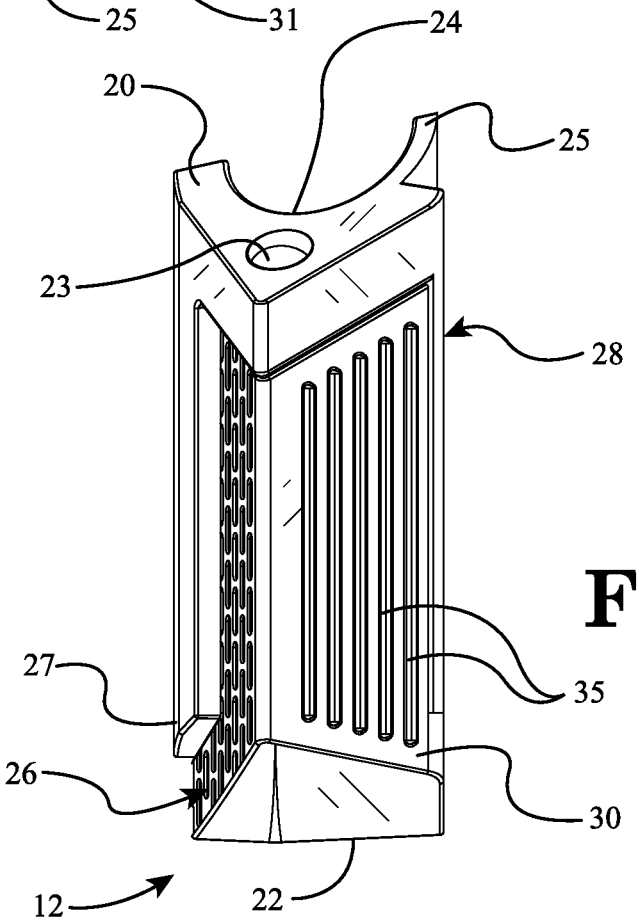
FIG. 8 is a side elevational view of the housing of FIG. 7.
Figure 9:
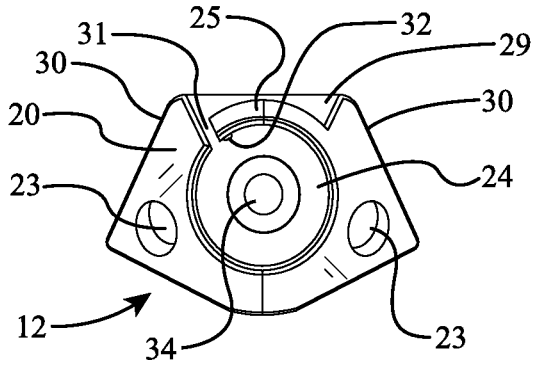
FIG. 9 is a top plan view of the housing of FIG. 7.
Figure 10:
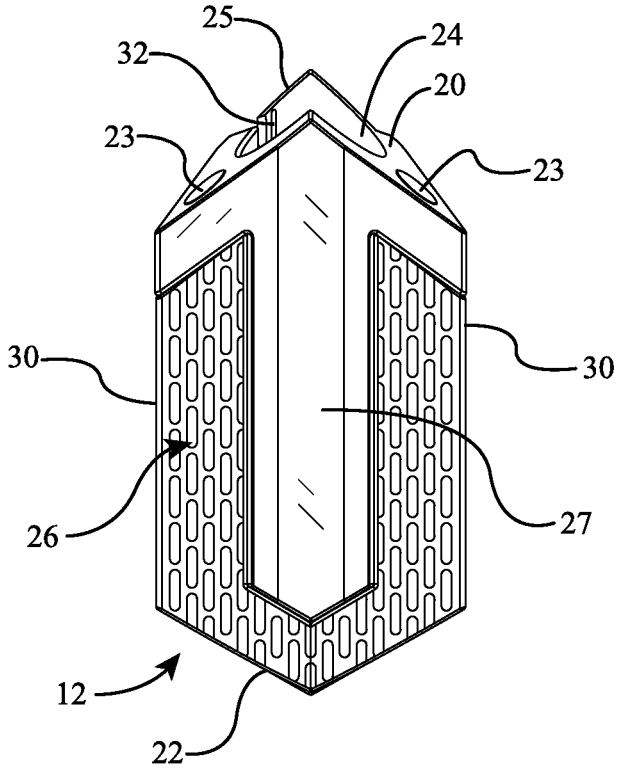
FIG. 10 is a front elevational view of the housing of FIG. 7.

Turning to FIGS. 7-11, it can be seen that the body portion or housing 12 of the applicator mounting apparatus 10 includes a first end 20 and a second end 22. The first end 20 includes an elongate applicator cavity 24 formed therein and extending along a length of the housing 12 towards the second end 22. The cavity 24 is configured to receive and secure the applicator 100 therein. The cavity 24 has a shape corresponding to a shape of the applicator 100 (e.g., see FIGS. 12 and 13). In the embodiment shown, the cavity 24 has a substantially cylindrical shape to correspond to the applicator 100 having a substantially cylindrical shape. However, the cavity 24 can have any shape as desired to correspond to an applicator having any shape such as a spherical shape, a cuboidal shape, a conical shape, a triangular prism shape, and a pyramidal shape, for example. As best illustrated in FIGS. 7 and 9, the inner circular wall bounding the cavity 24 may be provided with an elongate protrusion or projecting rail 32 extending along an axial length of the cavity 24. When an applicator 100 is disposed in the cavity 24, the elongate protrusion 32 engages the side of the applicator 100 along the length thereof in order to retain the applicator 100 in a more secure engagement within the cavity 24 (i.e., the elongate protrusion 32 exerts a force against the side of the applicator 100 to hold it in place). As shown in FIGS. 7 and 8, the first end 20 of the housing 12 may further include a pointed tip 25 extending from the back side thereof. Advantageously, when the housing 12 is being engaged with the mount 14 by a user thereof, the pointed tip 25 of the housing 12 prevents the exposed end portion 102 of the dispensed substance (e.g., lip balm—see FIGS. 12 and 13) in the applicator 100 from contacting the curved front surface 40 of the mount support member 36, and potentially becoming contaminated. In the embodiment shown, both the first end 20 and the second end 22 of the housing 12 are formed by two diagonally disposed, generally planar surfaces that come to a point (e.g., refer to FIG. 10). However, in alternative embodiments, it is to be understood that the first end 20 and the second end 22 of the housing 12 may also be formed using other suitable shapes.

Figure 19:
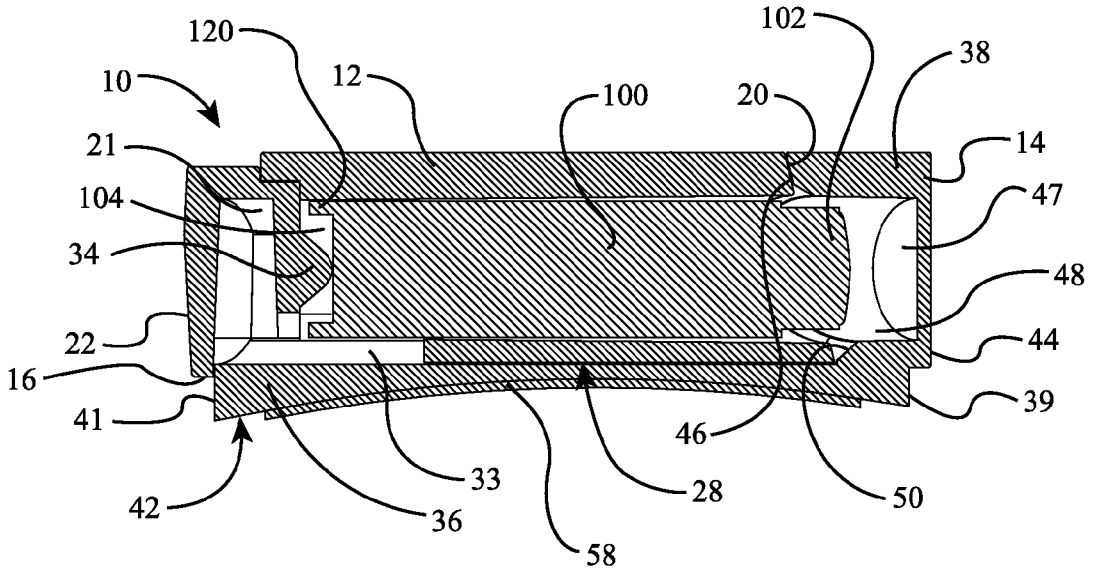
FIG. 19 is a first longitudinal sectional view of the applicator mounting apparatus of FIG. 1, wherein the section is generally cut along the cutting-plane line B-B in FIG. 3.

As shown in FIG. 19, the rear peripheral edge 16 of the housing 12 may overlap the mount support member 36 so as to prevent the inadvertent disengagement of the housing 12 from the support member 36 of the mount 14. In the illustrated embodiment, the rear peripheral edge 16 of the housing 12 overlaps the support member 36 on all three (3) exposed edges of the housing 12 (i.e., on all edges of the housing 12 except the interface edge) when the housing 12 is engaged with the mount 14. The overlapping peripheral edge 16 of the housing 12 prevents its inadvertent disengagement from the mount 14 because, in order for the housing 12 to become disengaged from the mount 14, it would need to lift up and clear the overlapping edge 16 of the housing 12 in order to move, or be pushed off the mount 14 in a side-to-side direction. As such, if a user accidentally contacts the housing 12, the overlapping edge 16 of the housing 12 generally prevents it from becoming disengaged from the mount 14.

Figure 12:
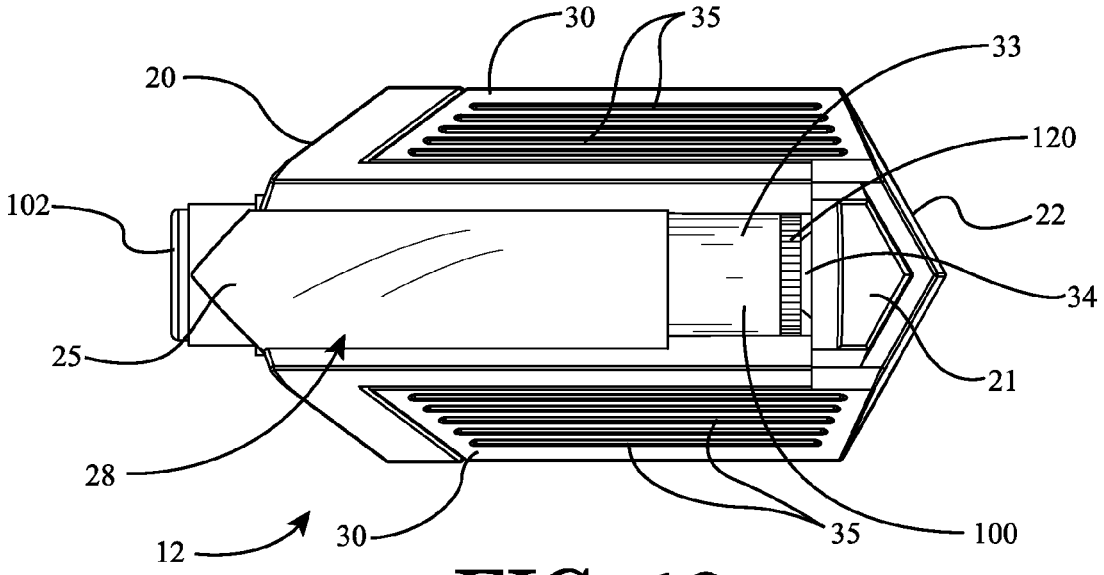
FIG. 12 is a rear elevational view of the housing of FIG. 7 with an applicator disposed therein.
Figure 20:
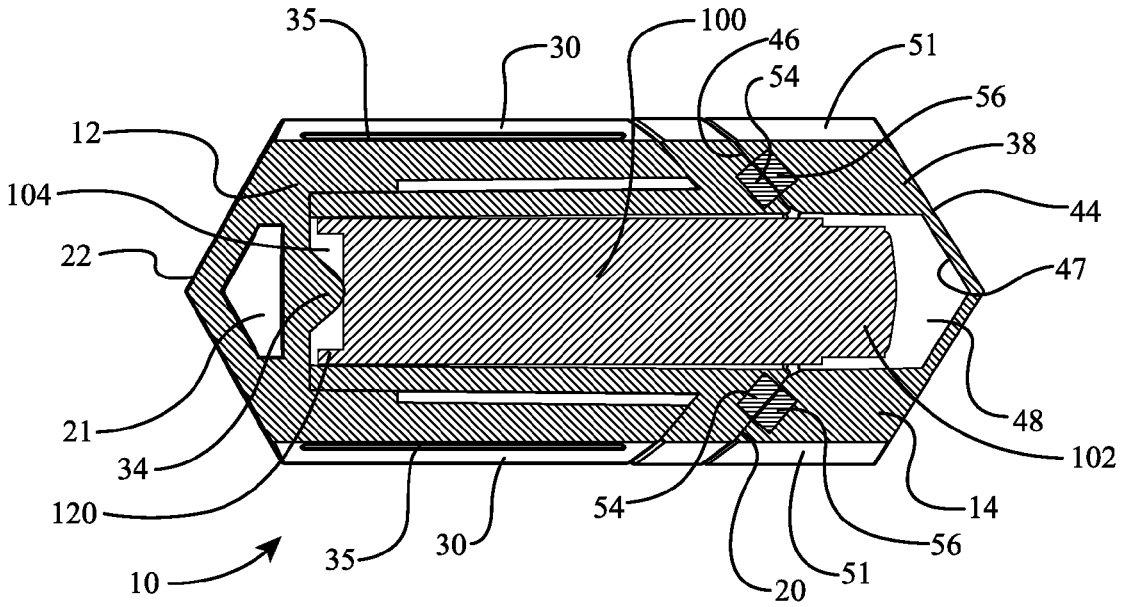
FIG. 20 is a second longitudinal sectional view of the applicator mounting apparatus of FIG. 1, wherein the section is generally cut along the cutting-plane line A-A in FIG. 2.

In FIGS. 12 and 20, it can be seen that the housing 12 may include a mold cavity 21 disposed near the second end 22 thereof. Advantageously, the mold cavity 21 in the housing 12 reduces the amount of material (e.g., plastic) that is required to form the housing 12, thereby reducing the overall material cost associated with the applicator mounting apparatus 10. While the mold cavity 21 has a generally five-sided polygonal shape in the illustrated embodiment of FIGS. 12 and 20, it is to be understood that the cavity 21 may be formed using a variety of suitable shapes, such as a rectangular shape, elliptical shape, etc.

Figure 11:
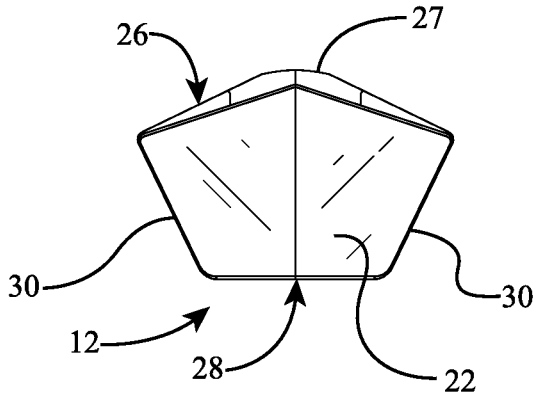
FIG. 11 is a bottom plan view of the housing of FIG. 7.
Figure 37:
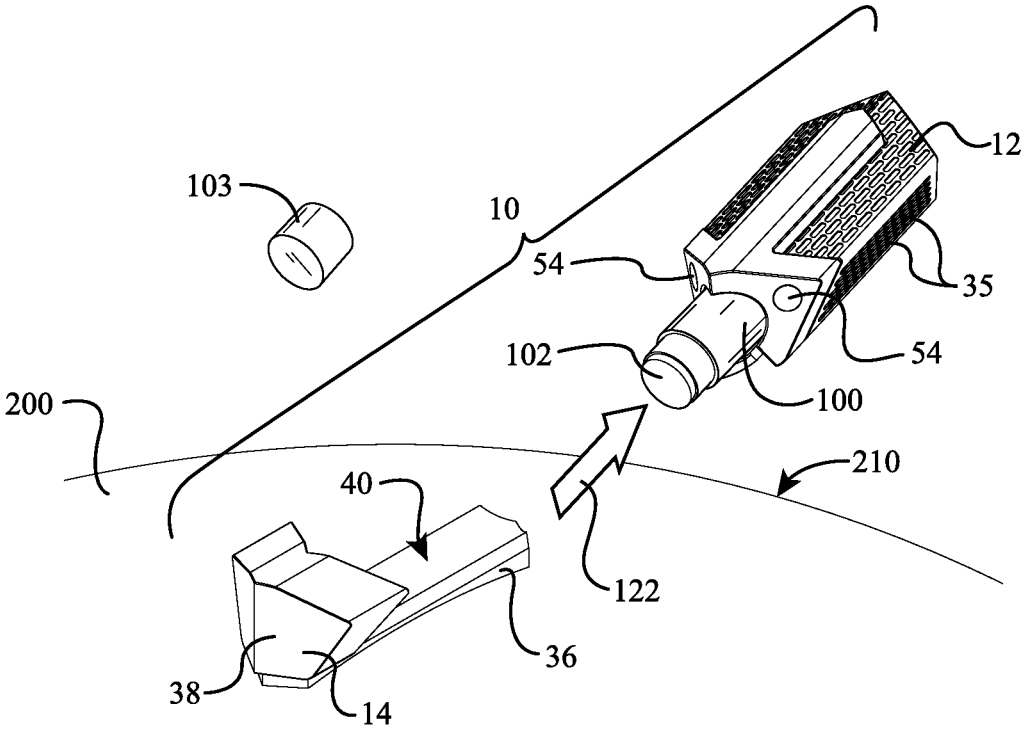
FIG. 37 is another front-end perspective view of the applicator mounting apparatus of FIG. 1 attached to a surface of a helmet, wherein the applicator is shown being inserted into the applicator mounting apparatus and the cap of the applicator is shown being removed.

Referring again to FIGS. 7-11, it can be seen that the housing 12 further includes a first surface 26, a second surface 28, and tapered sides 30. In the embodiment illustrated, the first surface 26 has a substantially flat portion 27 disposed in the center thereof for accommodating a product name or logo, while the remainder of the first surface 26 is generally formed by a textured surface with a pattern of elongate indentations formed therein. As best illustrated in FIGS. 7 and 11, the first surface 26 may comprise a generally symmetrical, gradual downward taper from a center thereof towards opposing sides 30. However, in other embodiments, the first surface 26 may have a substantially flat surface geometry. The second surface 28 of the housing 12 is configured to mate with the rail-like support member 36 of the mount 14. As such, the second surface 28 has an elongate groove 29 formed therein (e.g., see FIG. 9) that substantially corresponds to the upper surface geometry of the support member 36 of the mount 14. In the embodiment shown, the bounding wall of the elongate groove 29 has a substantially arcuate cross-sectional shape (i.e., a convex cross-section) that matingly engages with the substantially concave cross-sectional shape of the front surface 40 of the support member 36 of the mount 14. However, the elongate groove 29 may be formed using other suitable shapes that correspond to the shape of the front surface 40 of the support member 36. In FIGS. 7 and 9, it can be seen that the second surface 28 also includes an elongate slot 31 formed along one side of the elongate groove 29 (i.e., along the left side of the groove 29 in FIG. 9) that extends substantially the entire length of the elongate cavity 24. The elongate slot 31 extends completely through the housing 12 and is in communication with the elongate applicator cavity 24 of the housing 12. As such, the elongate slot 31 creates a gap in a portion of the housing wall surrounding the applicator cavity 24 so as to enable the housing wall to flex when the applicator 100 is inserted into the cavity 24 (see FIG. 37). Thus, the resilient nature of the housing wall facilitated by the elongate slot 31, together with the elongate protrusion 32 described above, enables the applicator 100 to be securely retained within the cavity 24 without free rotation or excessive movement. In FIG. 12, it can be seen that the second surface 28 further includes an aperture 33 disposed near the second end 22 of the housing 12 for gaining access to the dispensing mechanism 120 (i.e., rotatable finger wheel) of the applicator 100. The aperture 33 is generally rectangular in shape and extends a substantial distance along the axial length of the applicator 100 so as to give the user sufficient access to the dispensing mechanism 120 of the applicator 100. Advantageously, the aperture 33 enables a user to gain access to the dispensing mechanism 120 of the applicator 100 without requiring the applicator 100 to be removed from the housing 12.

Referring to FIGS. 9, 12, 19, 20, and 24, it can be seen that the elongate applicator cavity 24 of the housing 12 includes a substantially conical projection 34 disposed at the bottom thereof. More particularly, the substantially conical projection 34 extends from the bottom circular wall of the cavity 24, and into to the lower end portion of cavity 24. When the applicator 100 is disposed in the cavity 24, the substantially conical projection 34 engages the cylindrical recess 104 in the bottom end of the applicator 100 (see FIGS. 19 and 20) and spaces the bottom annular surface of the dispensing mechanism or wheel 120 apart from the bottom wall of the cavity 24 so that the applicator wheel 120 does not contact the bottom wall of the cavity 24 when it is turned by a user. As such, the substantially conical projection 34 enables the dispensing wheel 120 to be freely rotated by a user without its rotation being inhibited by contact with the bottom wall of the cavity 24.

Figure 5:
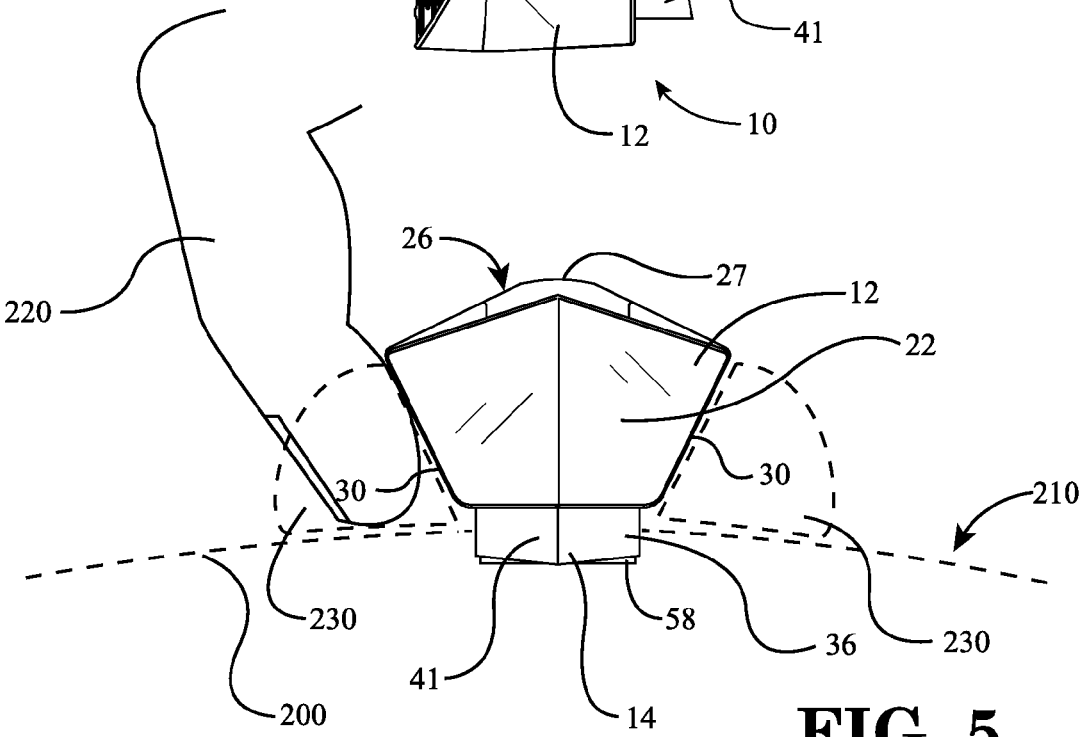
FIG. 5 is an end view of the applicator mounting apparatus of FIG. 1 attached to a surface of a helmet, according to one embodiment of the invention.
Figure 6:
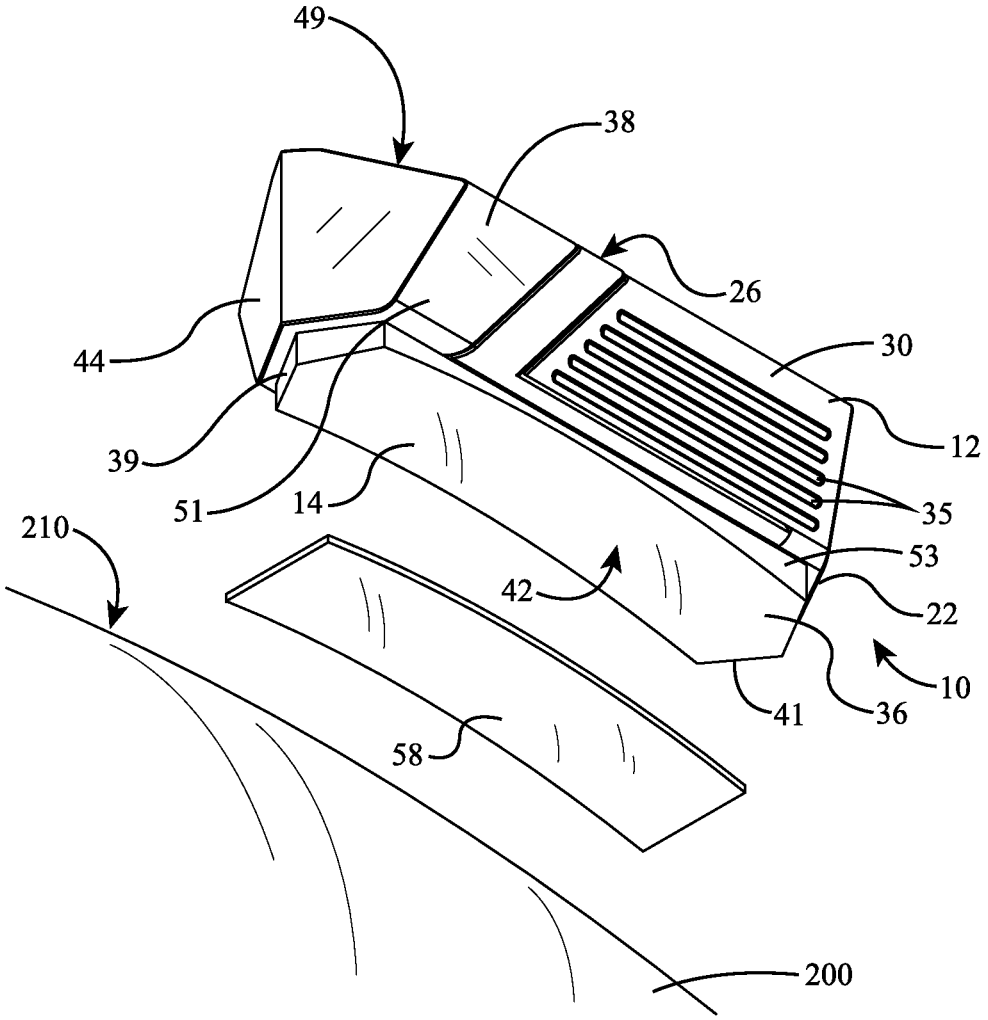
FIG. 6 is a partially exploded perspective view of the applicator mounting apparatus of FIG. 1 illustrating the manner in which the applicator mounting apparatus is attached to the surface of the helmet, according to one embodiment of the invention.

With reference to FIGS. 5, 7, 8, and 12, it can be seen that the tapered sides 30 of the housing 12 are configured to facilitate the gripping of the housing 12 of the applicator mounting apparatus 10 by a user thereof. In particular, as best shown in FIG. 5, the downwardly tapered sides 30 of the housing 12 are provided with an ergonomic slope so as to enable a user to easily and securely grasp the housing 12 with his or her fingers 220 (e.g., so as to remove the housing 12 from the mount 14). In FIG. 5, the gripping areas 230 of the housing 12 are diagrammatically indicated. Each of these gripping areas 230 is disposed adjacent to a respective one of the downwardly tapered sides 30. In the embodiment shown, the tapered sides 30 are substantially planar and have an inward taper towards the support member 36 of the mount 14. As illustrated in FIGS. 4, 7, 8, and 12, the tapered sides 30 of the housing 12 can further include a textured gripping surface with a plurality of elongate grooves 35 spaced apart from one another about the height of each of the tapered sides 30. Advantageously, the elongate grooves 35 in each of the tapered sides 30 of the housing 12 facilitate holding and gripping the housing 12 by enhancing the friction contact between the fingers 230 of the user and the sides 30 of the housing 12. In other embodiments, rather than indentations in the form of elongate grooves 35, the tapered sides 30 may comprise another type of textured gripping pattern, such as that formed by knurling or protrusions, for enhancing a grip of a user on the housing 12.

Referring to FIGS. 7-10, it can be seen that the housing 12 further includes a pair of cavities 23 disposed therein for receiving respective coupling devices. In the end view of FIG. 9, it can be seen that each of the cavities or bores 23 is disposed intermediate the elongate applicator cavity 24 of the housing 12 and one of the tapered sides 30 (i.e., between a respective side of the cavity 24 and a respective one of the sides 30). While two cavities 23 for accommodating two respective coupling devices are shown in the illustrated embodiment, it is to be understood that the housing 12 may include any suitable number of coupling device cavities 23, such as more than two coupling device cavities or fewer than two coupling device cavities. In the illustrated embodiment (see e.g., FIGS. 20 and 24), the coupling devices 54, 56 are in the form of cylindrical magnets for magnetically coupling for the housing 12 to the mount 14. The magnets 54 are each received within a respective one of the cavities 23 in the housing 12, while the magnets 56 are each received within a respective cylindrical cavity or bore 37 disposed in the mount 14, as will be described hereinafter. While the coupling devices 54, 56 of the illustrated embodiment are in the form of cylindrical magnets, it is to be understood that other suitable coupling devices may also be used, such as hook or loop components for a hook-and-loop system, bolts, fasteners, latches, adhesives, a snap fit component, or other suitable coupling device. The coupling devices 54 may be affixed to their respective cavities 23 of the housing 12 using a suitable adhesive or glue.

Figure 24:
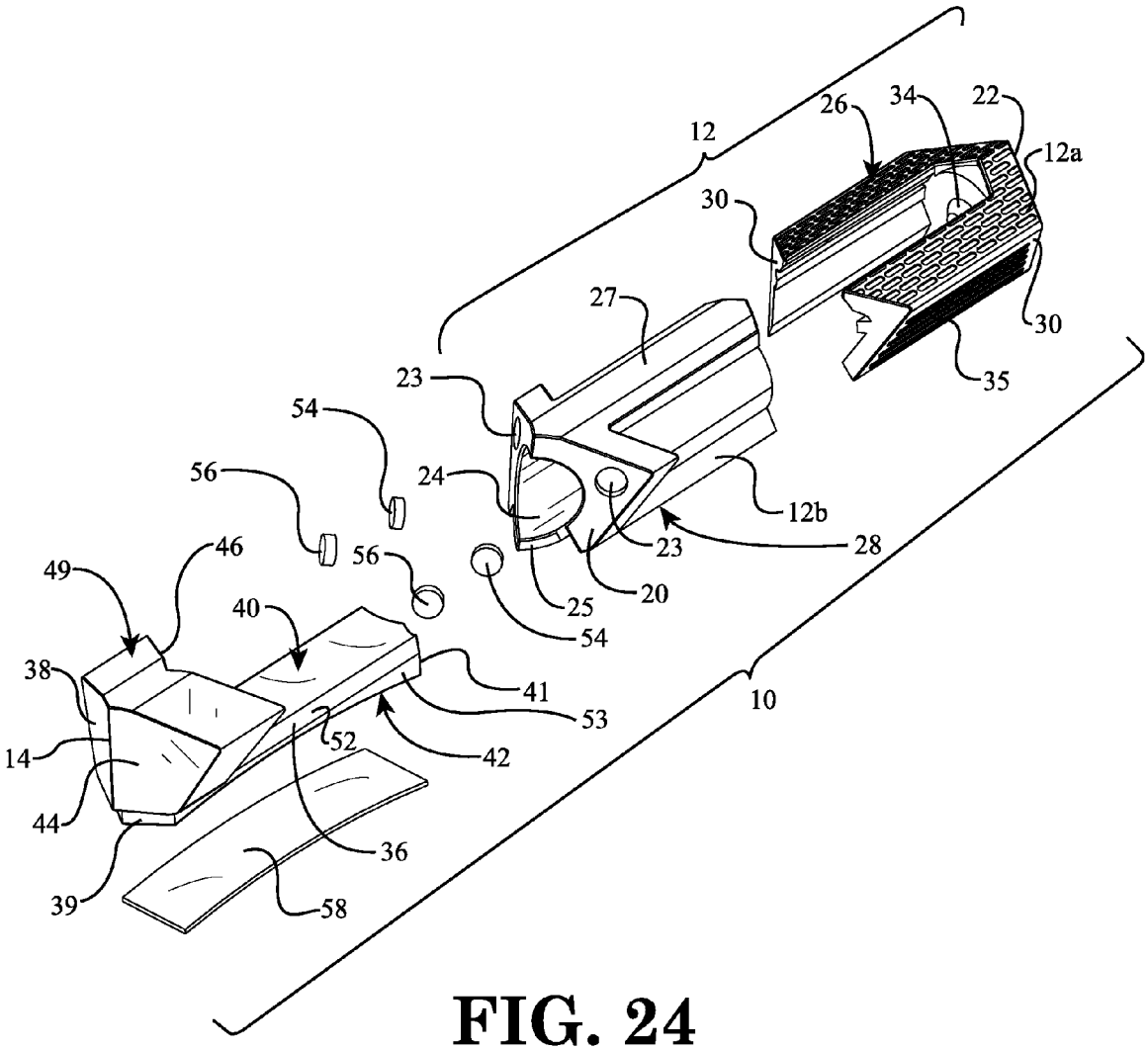
FIG. 24 is an exploded perspective view of the applicator mounting apparatus of FIG. 1.

Turning to the exploded view of FIG. 24, it can be seen that the housing 12 of the applicator mounting apparatus 10 may be formed in two parts, namely a first housing part 12*a* and a second housing part 12*b*. Advantageously, forming the housing 12 from two parts 12*a*, 12*b* easily enables the housing 12 to be constructed from two different colored materials (e.g., two different colors of plastic). Referring again to FIG. 24, in the illustrated embodiment, the first housing part 12*a* is configured to be slidingly engaged with second housing part 12*b*, and then secured in place using suitable attachment means, such as a suitable adhesive or glue, or a permanent sonic weld between the components 12*a*, 12*b*. In an alternative embodiment, rather than being formed from two separate components 12*a*, 12*b*, the housing 12 may be formed as a single unit (i.e., using one-piece construction wherein all of the features of the housing 12 are integrally formed as a single component).

As illustrated in FIGS. 14-18, the mount 14 includes a support member 36 and an engagement member 38 integrally formed with the support member 36. The support member 36 is configured to mount to a surface (e.g., a surface 210 of a helmet—see FIG. 5) and has a first end 39, a second end 41, and a concave surface 40 configured to engage with the convex surface of the groove 29 of the housing 12. Also, the support member 36 of the mount 14 also includes a pair of generally parallel, oppositely disposed side surfaces 53 and pair of chamfered edges 52 connecting the side surfaces 53 to the concave front surface 40. Similar to that described above for the first and second ends 20, 22 of the housing 12, the first and second ends 39, 41 of the support member 36 are formed by two diagonally disposed, generally planar surfaces that come to a point (e.g., refer to FIGS. 14, 15, and 17). The front surface 40 has a curvature in the widthwise direction of the support member 36 (i.e., the top surface of the cross-section of the support member 36 is concave). The curved front surface 40 of the support member 36 corresponds to the geometry of the curved bounding wall of the groove 29 in the housing 12 so that the second surface 28 of the housing 12 is in mating contact with the surface 40 of the support member 36 of the mount 14 when the housing 12 is engaged with the support member 36 of the mount 14. In the embodiment shown, the rail-like support member 36 of the mount 14 has a cross-sectional width that is substantially less than the median cross-sectional width of the housing 12 so that a user does not inadvertently apply a removal force to the mount 14 instead of the housing 12 when disengaging the housing 12 from the mount 14. That is, the problem of pulling on the support member 36, rather than on the housing 12 as intended, is alleviated by making the cross-sectional width of the support member 36 significantly less than median cross-sectional width of the housing 12. Thus, the likelihood of the user inadvertently disengaging the mount 14 from the mounting surface to which it is attached is greatly reduced. In FIGS. 4, 6, 14, 18, and 24, it can be seen that the support member 36 of the mount 14 further includes a curved back surface 42 that is configured to be affixed to a corresponding curved mounting surface, such as the curved outer surface 210 of the helmet 200 illustrated in FIGS. 6 and 25. The curved back surface 42 is disposed generally opposite to the curved front surface 40 of the support member 36. Unlike the concave curvature of the curved front surface 40, the continuous concave curvature of the curved back surface 42 is in a lengthwise direction of the support member 36 (i.e., the slope of curvature of the back surface 42 of the support member 36 varies from its first end 39 to its second end 41. As best shown in FIGS. 2, 5, 6, and 24, the support member 36 further includes an attachment means 58, such as an adhesive strip or other suitable attachment means, configured to securely couple the mount 14 to a surface (e.g., a surface 210 of a helmet—see FIG. 5). In particular, the attachment means 58 affixes the curved back surface 42 of the mount 14 to the mounting surface.

Figure 14:
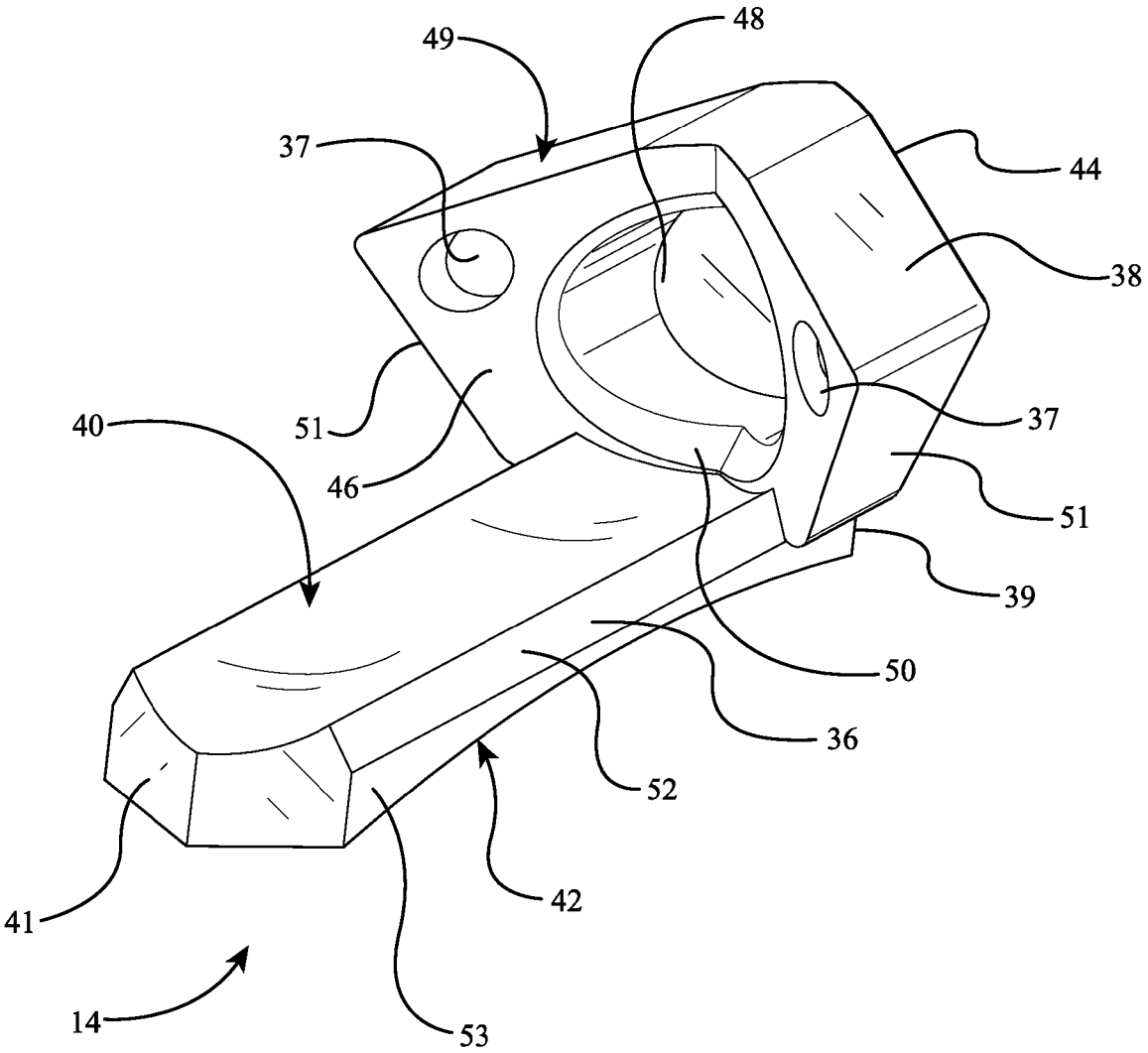
FIG. 14 is a front-end perspective view of the mount of the applicator mounting apparatus of FIG. 1.
Figure 15:
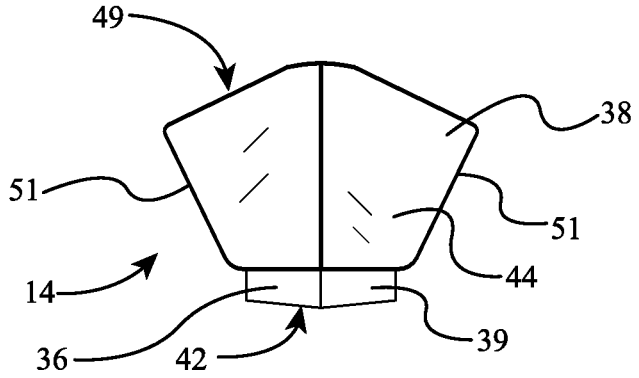
FIG. 15 is a top plan view of the mount of FIG. 14.
Figure 16:
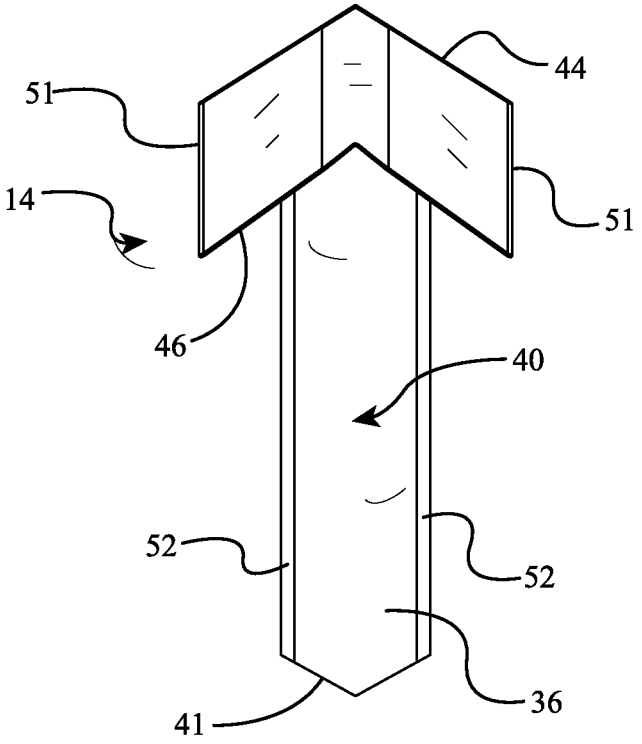
FIG. 16 is a front elevational view of the mount of FIG. 14.
Figure 18:
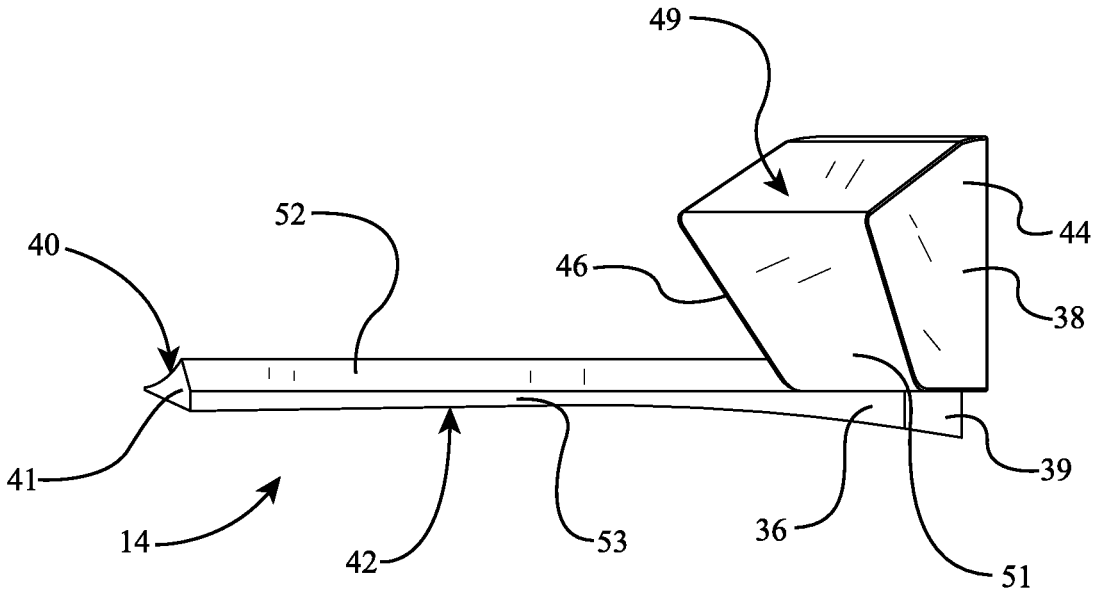
FIG. 18 is a side elevational view of the mount of FIG. 14.

Referring to FIGS. 14 and 18, it can be seen that the engagement member 38 is disposed adjacent the first end 39 of the support member 36. When the mount 14 is affixed to a mounting surface, the engagement member 38 extends in a cantilevered manner from the support member 36. The engagement member 38 includes an interface 46 configured to engage with the first end 20 of the housing 12 and a cylindrical cavity 48 configured to receive a portion of the applicator 100 formed therein. As best shown in FIGS. 14 and 16, the interface 46 is formed by two diagonally disposed, generally planar surfaces, each of which inwardly slopes towards a central valley disposed in the approximate center of the engagement member 38 (and approximately aligned with the axial centerline of the cylindrical cavity 48). The oppositely disposed, pointed end wall 44 of the engagement member 38 comprises two diagonally disposed, generally planar surfaces, each of which is generally parallel to a respective one of the planar surfaces forming the interface 46 of the engagement member 38. When the housing 12 is engaged with the mount 14, the interface surface 46 of the engagement member 38 abuts the first end surface 20 of the housing 12, and the cylindrical cavity 48 of the engagement member 38 is generally aligned with the elongate applicator cavity 24 of the housing 12. As best shown in FIGS. 1, 3, 4, and 6, the engagement member 38 has a surface 49 substantially continuous with the first surface 26 of the housing 12 and tapered sides 51 substantially continuous with the tapered sides 30 of the housing 12.

Figure 17:
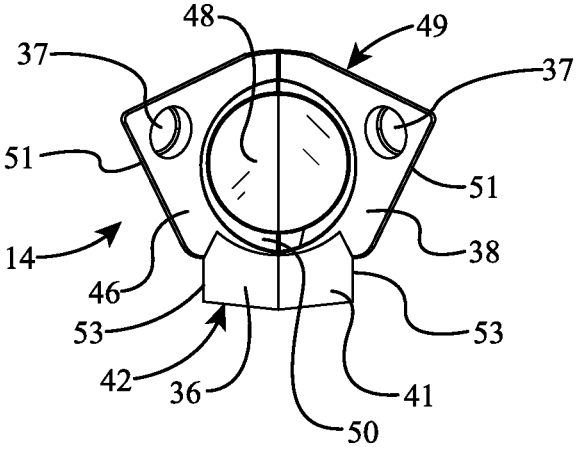
FIG. 17 is a bottom plan view of the mount of FIG. 14.

Once the applicator 100 is inserted into the housing 12 of the applicator mounting apparatus 10, the cap of the applicator 100 is typically removed and discarded (e.g., a cap that is sold with a lip balm stick). When using the applicator mounting apparatus 10, the cap sold with the applicator 100 is no longer necessary because the hood-like engagement member 38 of the mount 14 serves as cap for the applicator 100 (i.e., the hood-like engagement member 38 becomes the cap of the applicator 100). That is, when the housing 12 is engaged with the mount 14, the cylindrical cavity 48 of the engagement member 38 receives the exposed end portion 102 of the applicator 100 so as to cover the end portion 102. As shown in FIGS. 14 and 17, the cylindrical cavity 48 of the engagement member 38 comprises a chamfered or tapered edge 50 disposed around the periphery thereof in order to facilitate the insertion of the end portion 102 of the applicator 100 into the cavity 48, particularly when the applicator mounting apparatus 10 is mounted in a location that is not visible to the user (e.g., on a helmet worn on the head of the user). Turning to the longitudinal sectional views of FIGS. 19 and 20, it can be seen that the end wall 47 of the cylindrical cavity 48 comprises tapered interior surfaces that converge to a valley.

As shown in FIGS. 14 and 17, it can be seen that the engagement member 38 further includes a pair of cavities or bores 37 disposed on the interface 46 thereof for receiving respective coupling devices. In the end view of FIG. 17, it can be seen that each of the cavities or bores 37 is disposed intermediate the cavity 48 of the engagement member 38 and one of the opposing sides 51 thereof (i.e., between a respective side of the cavity 48 and a respective one of the sides 51). As explained above, each of the cavities 37 receives a respective coupling device (e.g., magnet 56). The coupling devices (e.g., magnets 56) of the engagement member 38 are substantially aligned with the coupling devices (e.g., magnets 54) of the housing 12 (see FIG. 20) and are configured to releasably engage with the coupling devices (e.g., magnets 54) of the housing 12. While two cavities 37 for accommodating two respective coupling devices are shown in the illustrated embodiment, it is to be understood that the engagement member 38 may include any suitable number of coupling device cavities 37, such as more than two coupling device cavities or fewer than two coupling device cavities. In the illustrated embodiment (see e.g., FIGS. 20 and 24), the coupling devices 54, 56 are in the form of cylindrical magnets for magnetically coupling the housing 12 to the mount 14. While the coupling devices 54, 56 of the illustrated embodiment are in the form of cylindrical magnets, it is to be understood that other suitable coupling devices may also be used, such as hook or loop components for a hook-and-loop system, bolts, fasteners, latches, adhesives, a snap fit component, or other suitable coupling device. The coupling devices 56 may be affixed to their respective cavities 37 of the housing using a suitable adhesive or glue.

Each of the housing 12 and the mount 14 may be formed from plastic by any plastic forming process such as molding, injection molding, 3D printing, thermoforming, or any other plastic forming process as desired, for example. However, each of the housing 12 and the mount 14 may be formed from any durable material such as metal or wood and formed from any process, as desired. The housing 12 may be integrally formed, or may be formed from separate components 12*a*, 12*b* (as described above), and later coupled to each other. Similarly, the support member 36 and the engagement member 38 may be integrally formed or separately formed and later coupled to each other.

Figure 13:
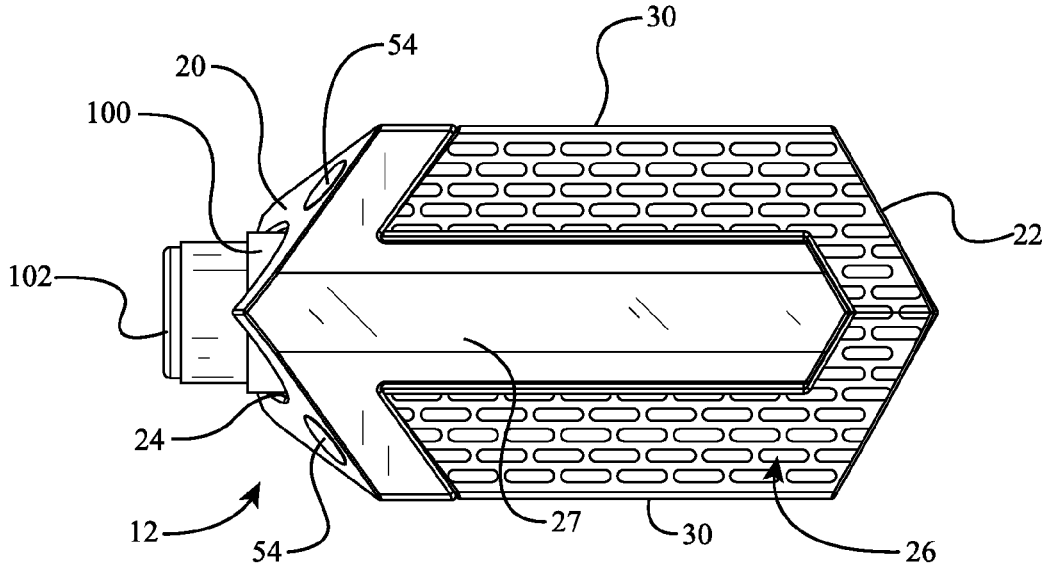
FIG. 13 is a front elevational view of the housing of FIG. 7 with the applicator disposed therein.
Figure 36:
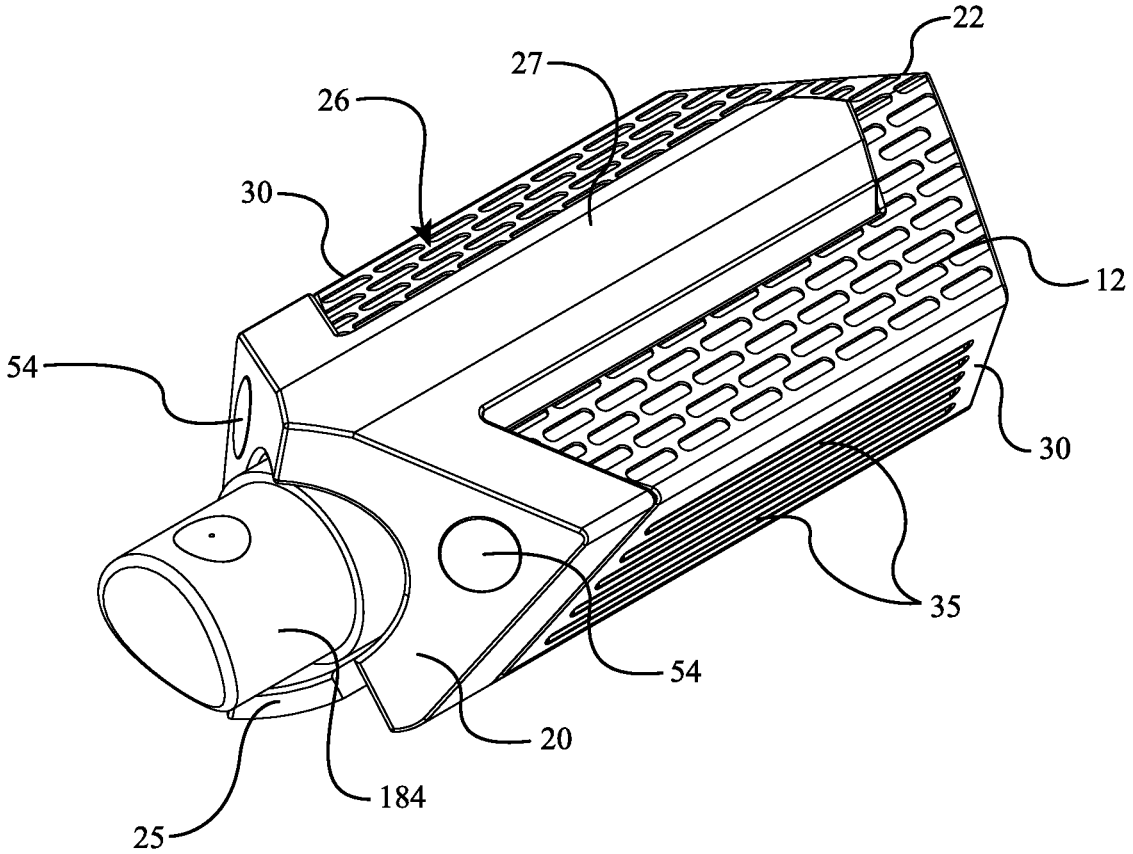
FIG. 36 is a front-end perspective view of the housing of the applicator mounting apparatus of FIG. 1, wherein another type of applicator is disposed in the housing.

To assemble, an applicator 100 is received in the cavity 24 of the housing 12. The applicator 100 can include a cap and dispensing means 120 such as dispensing dial or wheel 120 for dispensing the product (see e.g., FIGS. 12, 19, and 20). The applicator 100 may be any applicator for dispensing a substance for application on a body portion of a user or on an object. In one or more embodiments, the applicator may contain a cosmetic product. For example, as illustrated in FIGS. 12 and 13, the applicator 100 contains lip balm such as CHAPSTICK® brand lip balm, CARMEX® brand lip balm, BURT'S BEES® brand lip balm, etc. The applicator can have any shape such as cylindrical, cubical, spherical, or any other shape now known or later developed. The applicator may also be any other applicator containing cosmetics, such as sunblock or sunscreen, deodorant, lip gloss, and hair spray, for example. The applicator may also be any applicator containing any other product, such as a glue stick, insect repellent, perfume, etc. For example, as shown in FIG. 36, the housing 12 may accommodate an applicator in the form of a pump-type spray bottle 184, which contains insect repellant or another liquid substance. If the applicator 100 includes a cap, the cap 103 may be removed so that the product contained in the applicator 100 is exposed (e.g., see FIG. 37). The applicator 100 is received in the cavity 24 of the housing 12 so that the dispensing mechanism 120 is exposed through the aperture 33 in the second surface 28 of the housing 12 (see FIG. 12) and a portion of the applicator 100 extends from the first end 20 of the housing 12. It is to be understood that a product can also be directly received in the cavity 24 of the housing without an applicator.

Now, with reference to FIGS. 1-25 and 37, one illustrative method of using the applicator mounting apparatus 10 will be described. Initially, referring to FIG. 6, the mount 14 of the applicator mounting apparatus 10 is affixed to a mounting surface (e.g., a surface 210 of a helmet 200) using the attachment means 58 (e.g., a suitable adhesive strip). Then, the applicator body portion of the applicator 100 is inserted into the elongate applicator cavity 24 of the housing 12 of the applicator mounting apparatus 10 (as diagrammatically illustrated by the arrow 122 in FIG. 37). During the insertion of the applicator 100 into the cavity 24, the resilient wall portion surrounding the cavity 24, which has the elongate slot 31 formed therein, flexes so that the applicator 100 may be securely engaged in the cavity 24. Also, once the applicator 100 has been inserted into cavity 24, the elongate protrusion 32 exerts a force against the side of the applicator 100 to securely hold it in place. After which, the applicator cap 103 is removed from the applicator body portion of the applicator 100 so as to expose the end portion 102 of the applicator 100 (see FIGS. 12, 13, and 37). Finally, the housing 12 containing the applicator 100 is engaged with the mount 14 of the applicator mounting apparatus 10 such that the engagement member 38 of the mount 14 serves as a protective cap for the end portion 102 of the applicator 100 (see FIGS. 21 and 23). In particular, when the housing 12 of the applicator mounting apparatus 10 is engaged with the mount 14, the exposed end portion 102 of the applicator 100 is inserted into the cavity 48 of the engagement member 38 of the mount 14 so as to cover the end portion 102 of the applicator 100, thereby helping to prevent the contamination of the dispensed substance (e.g., lip balm).

The housing 12 is received into the mount 14 so that the groove 29 of the second surface 28 of the housing 12 aligns with the rail-like support member 36 of the mount 14 and the interface 46 aligns with the first end 20 of the housing 12. The cavity 48 of the engagement member 38 receives at least a portion of the applicator 100 (e.g., the exposed end portion 102) to form a cover for the product in the applicator 100. The coupling devices 54 of the housing 12 align with the coupling devices 56 of the engagement member 38 to releaseably couple the housing 12 to the mount 14. It is to be understood that the coupling devices 54 of the housing 12 may be disposed on any suitable portion of the housing 12 as desired and the coupling devices 56 of the mount 14 may be disposed on any suitable portion of the mount 14 as desired. For example, the coupling devices 54 of the housing 12 may be disposed on the second surface 28 of the housing 12 and the coupling devices 56 of the mount 14 may be disposed on the surface 40 of the support member 36 to align with the coupling devices 54 disposed on the second surface 28 of the housing 12.

Figure 21:
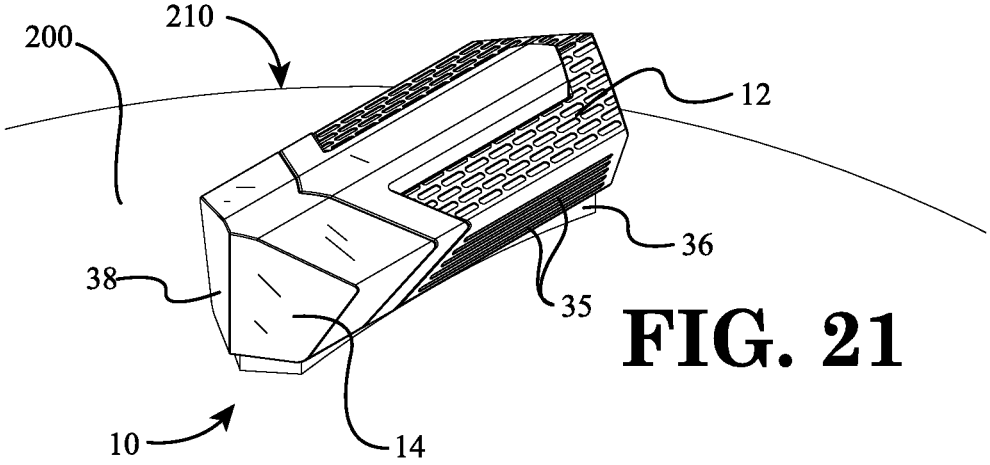
FIG. 21 is a front-end perspective view of the applicator mounting apparatus of FIG. 1 attached to a surface of a helmet, according to one embodiment of the invention, wherein the applicator mounting apparatus is shown in an assembled state.
Figure 22:
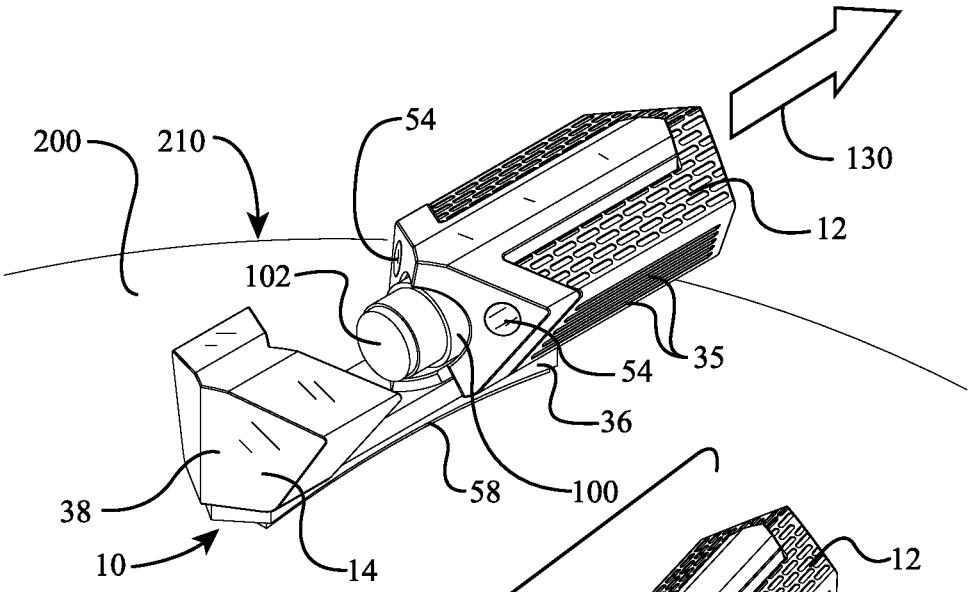
FIG. 22 is a front-end perspective view of the applicator mounting apparatus in the mounting arrangement of FIG. 21, wherein the housing of the applicator mounting apparatus is shown being removed from the mount of the applicator mounting apparatus.
Figure 23:
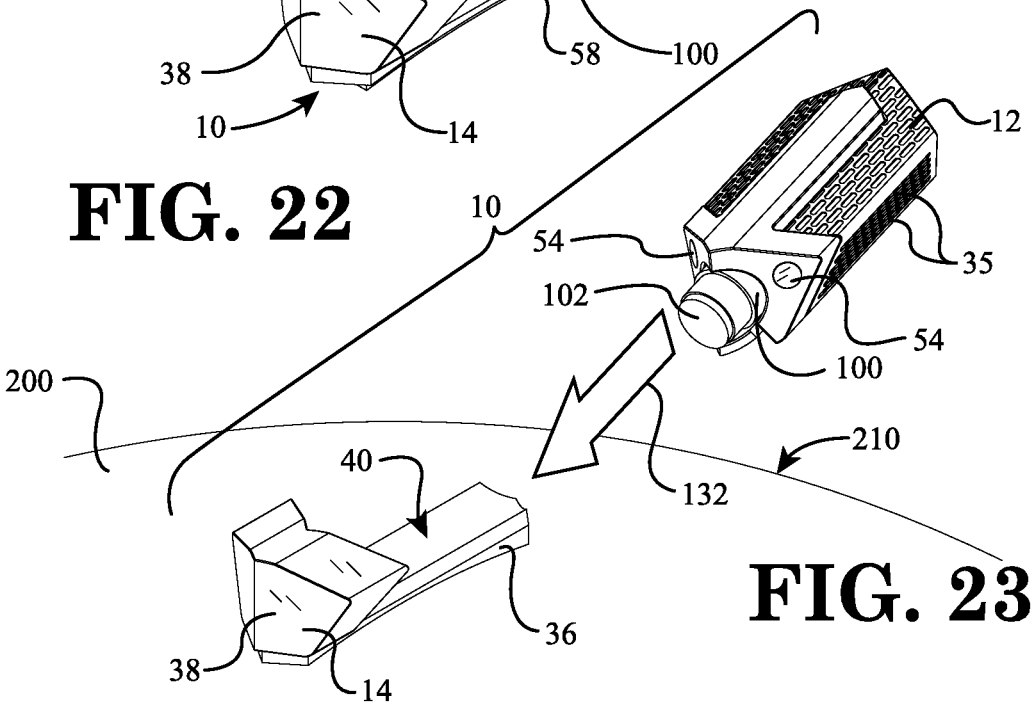
FIG. 23 is another front-end perspective view of the applicator mounting apparatus in the mounting arrangement of FIG. 21, wherein the housing of the applicator mounting apparatus is shown being attached to the mount of the applicator mounting apparatus.

Referring to FIGS. 21-23, the removal and attachment of the housing 12 to the mount 14 will be briefly described. In FIG. 22, the general direction of removal of the housing 12 from the mount 14 is diagrammatically illustrated by the arrow 130. As shown in this figure, to remove the housing 12 from the mount 14, a user generally pulls the housing 12 away from the mount 14 in a direction that is generally parallel to the axial or lengthwise direction of the support member 36 (i.e., the housing 12 may be removed at a slight acute angle relative to the lengthwise direction of the support member 36 in FIG. 22). Conversely, in FIG. 23, the general direction of attachment of the housing 12 to the mount 14 is diagrammatically illustrated by the arrow 132. As shown in this figure, to attach the housing 12 to the mount 14, a user generally approaches the mount 14 at a small acute angle relative to the axial or lengthwise direction of the support member 36 until the housing 12 is in contact engagement with the mount 14. In order to facilitate the attachment of the housing 12 to the mount 14, it is best for the user to avoid approaching the mount 14 with the housing 12 at too steep of an angle relative to the lengthwise direction of the support member 36.

Figure 25:
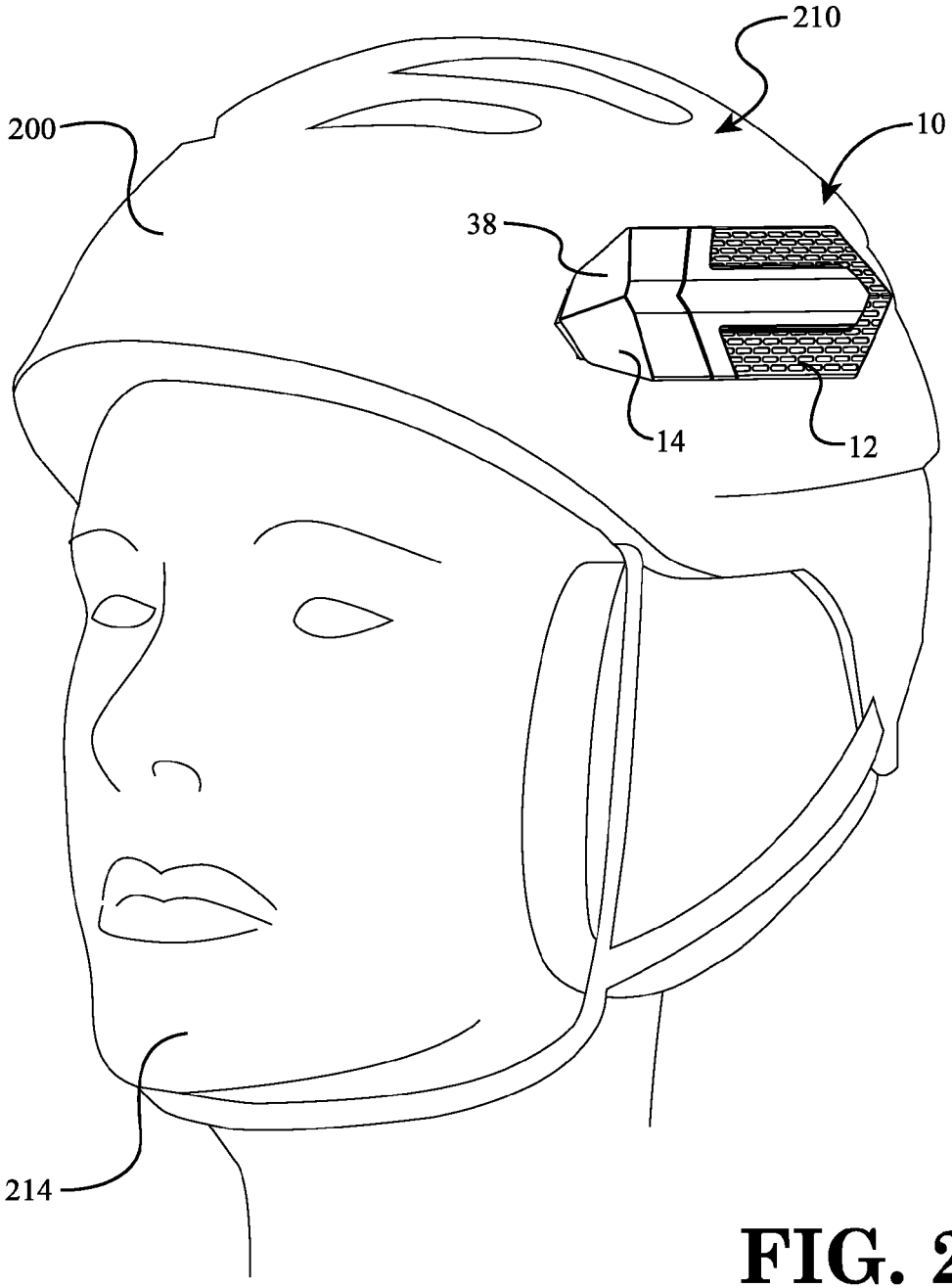
FIG. 25 is a perspective view of the applicator mounting apparatus of FIG. 1 attached to a surface of a helmet worn by a user, according to one embodiment of the invention.

According to an embodiment of the invention, as illustrated in FIG. 25, the applicator mounting apparatus 10 is being utilized by user 214 wearing a helmet 200. The mount 14 may be coupled to a surface 210 of the helmet 200 with suitable attachment means 58, such as 3M™ brand tape adhesive, or other suitable adhesive or coupling means as desired. The helmet 200 can be any type of helmet. In a non-limiting example, as shown in FIG. 23, a helmet for skiing or snowboarding is illustrated. However, the helmet 200 can be any protective head device such as a biking helmet, motorcycle helmet, hard hat, or any other protective head device. Additionally, the surface 210 may be any surface, such as a curved surface, a flat surface, a surface of a bicycle or motorcycle, a surface of a car, or any other surface as desired.

Once the mount 14 is coupled to the helmet 200, the housing 12 can be releasably coupled to the mount 14. The housing 12 is configured to stay coupled to the mount 14 on the helmet 200 until a user desires to use the applicator 100 so the user can effectively use the helmet 200 without restriction. Once the user desires to use the applicator 100, the housing 12 can be released from the mount 14 coupled to the helmet 200. The tapered sides 30 and the textured gripping surface with the plurality of elongate grooves 35 facilitate removal of the housing 12 from the mount 14 and facilitate gripping and holding the housing 12 for effortless application of the product contained in the applicator 100. The tapered sides 30 and the textured gripping surface also facilitate gripping of the housing 12 when the user may be wearing a protective layer on his or her hands, such as gloves, for example. Once the applicator 100 is no longer desired to be used, the housing 12 is positioned in engagement with the mount 14 to be coupled to the helmet 200 until further use.

Figure 26:
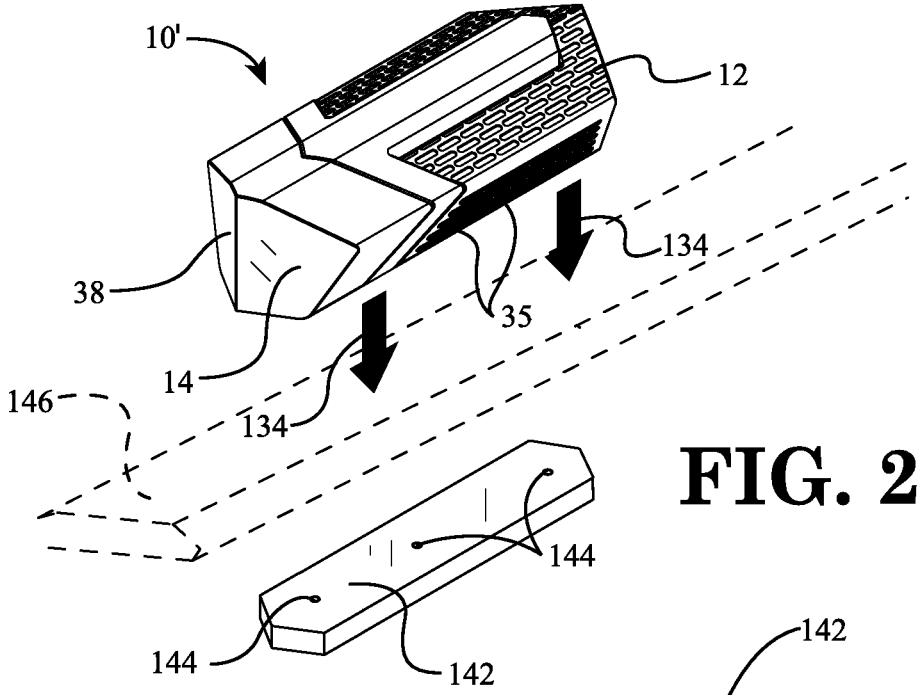
FIG. 26 is a front-end perspective view illustrating an applicator mounting apparatus with a first alternative type of attachment means, according to another embodiment of the invention.
Figure 27:
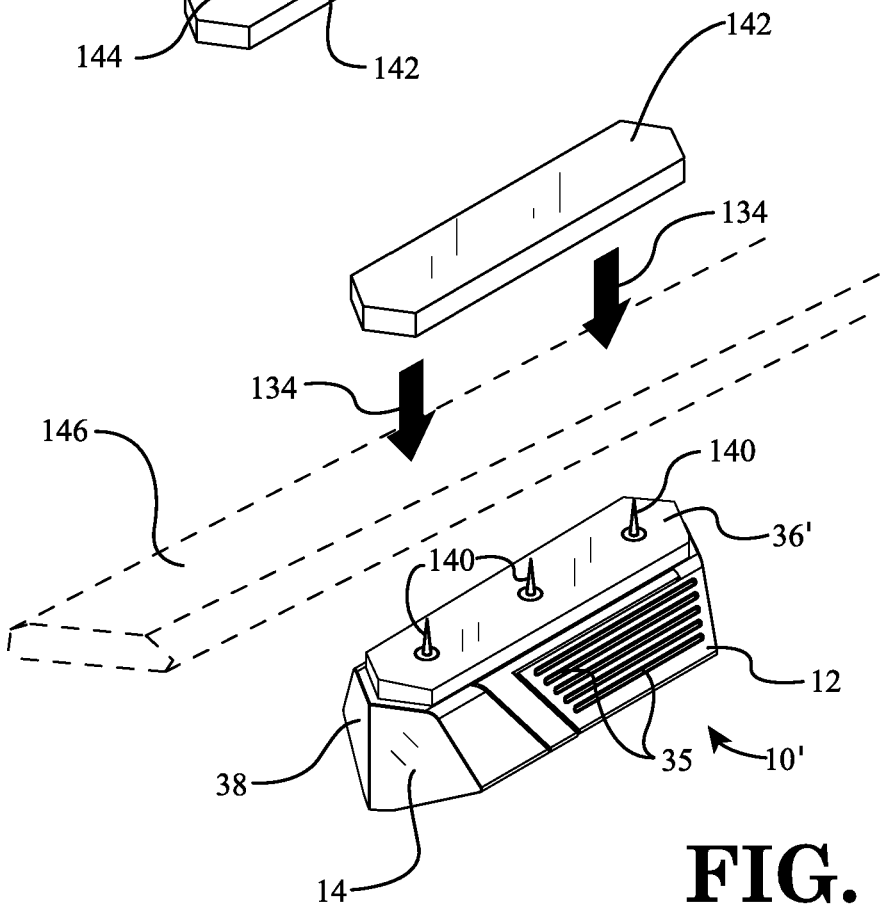
FIG. 27 is a rear-end perspective view illustrating the applicator mounting apparatus with the first alternative type of attachment means of FIG. 26.

Now, referring to FIGS. 26-35, illustrative embodiments of other suitable attachment means for securing the applicator mounting apparatus to a variety of different objects will be described. Initially, with reference to FIGS. 26 and 27, the attachment means that affixes the mount 14 of the applicator mounting apparatus 10' to an object mounting surface may comprise pin-type fastener devices. In particular, as shown in FIG. 27, the mount 14 may be provided with a support member 36' having a flat back surface, rather than the curved back surface 42 described above, so that a plurality of pins 140 may be accommodated therein. For example, the heads of each of the pins 140 may be embedded in the support member 36' of the mount 14 during the part molding process. In FIG. 27, it can be seen that the applicator mounting apparatus 10' is secured to a fabric strap 146 or a piece of fabric by piercing the fabric with the pointed pins 140, and then sandwiching the fabric between the support member 36' of the mount 14 and the generally planar pin backing strip 142 (e.g., as diagrammatically indicated by the arrows 134 in FIG. 27). In FIG. 26, it can be seen that the pin backing strip 142 may comprise a series of spaced-apart holes 144 disposed therein that correspond to the locations of each of the pins 140 so that the engagement between the pins 140 and the pin backing strip 142 may be facilitated. In the illustrated embodiment of FIGS. 26 and 27, the strip of fabric 146 may comprise the strap of a backpack or a pair goggles. Alternatively, the strip of fabric 146 may comprise a fabric portion of a coat, such as a ski coat.

Figure 28:
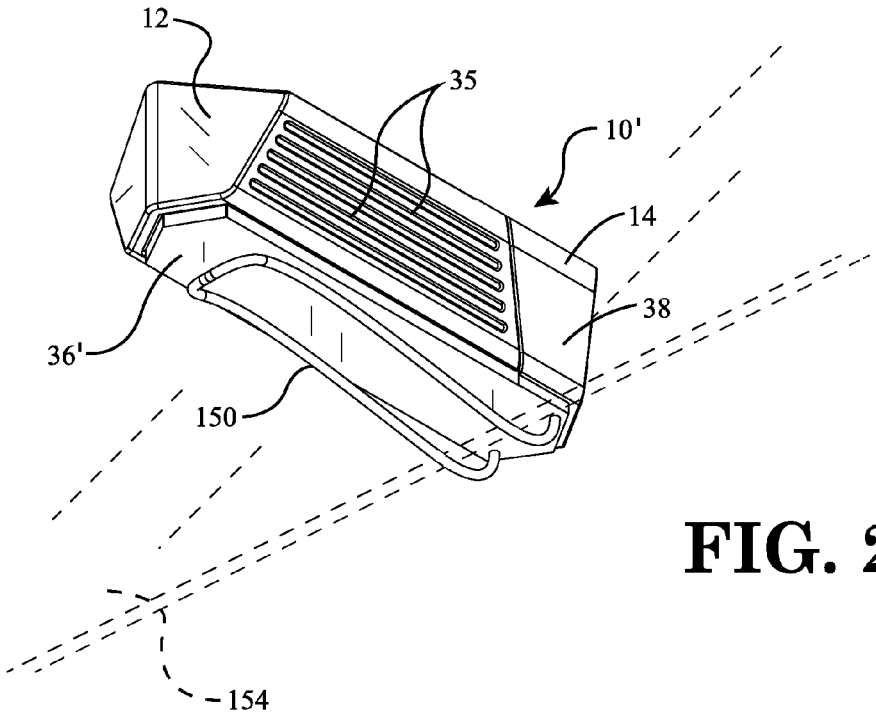
FIG. 28 is a rear-end perspective view illustrating an applicator mounting apparatus with a second alternative type of attachment means, according to yet another embodiment of the invention.
Figure 29:
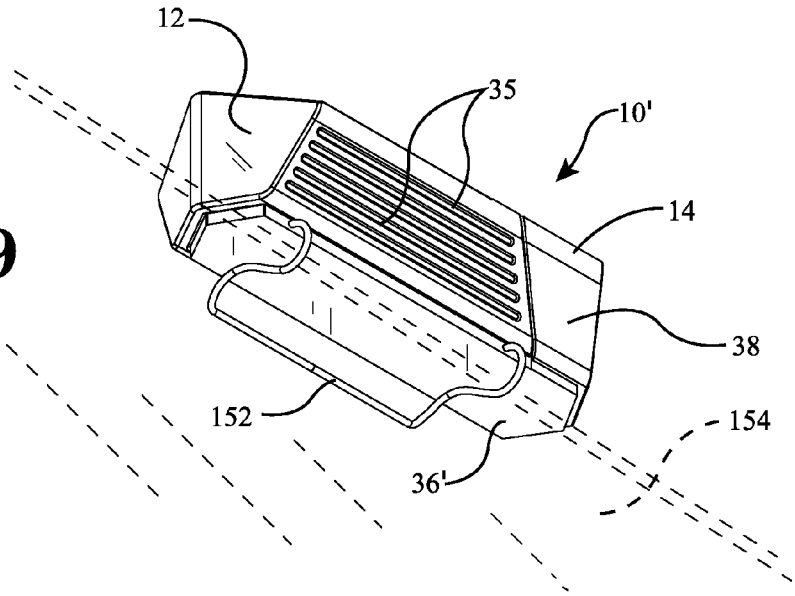
FIG. 29 is a rear-end perspective view illustrating an applicator mounting apparatus with a third alternative type of attachment means, according to still another embodiment of the invention.

Another type of attachment means by which the applicator mounting apparatus may be attached to an object is illustrated in FIGS. 28 and 29. In these figures, clipping mechanisms 150, 152 are used for securely coupling the applicator mounting apparatus 10' to a generally flat object 154 with a solid surface. In particular, as shown in FIG. 28, a first type of clipping mechanism 150 may be affixed to the support member 36' of the mount 14 of the applicator mounting apparatus 10'. For example, the first type of clipping mechanism 150 may comprise a bent wire type clip that is configured to engage the object 154 in a generally longitudinal direction of the applicator mounting apparatus 10'. As illustrated in FIG. 28, the bent wire type clip 150 may be formed from a resilient wire (e.g., a metallic metal) that elastically deforms when the clip 150 is engaged with the object 154, and thereby securely attaches the applicator mounting apparatus 10' to the object 154 by the applying a compressive force thereto. Turning to FIG. 29, a second type of clipping mechanism 152 may also be affixed to the support member 36' of the mount 14 of the applicator mounting apparatus 10'. Similar to the first type of clip 150, the second type of clipping mechanism 152 may also comprise a bent wire type clip. However, unlike the first type of clip 150, the second type of clipping mechanism 152 is configured to engage the object 154 in a generally transverse direction of the applicator mounting apparatus 10' Like the first type of clip 150, the bent wire type clip 152 illustrated in FIG. 29 may be formed from a resilient wire (e.g., a metallic metal) that elastically deforms when the clip 152 is engaged with the object 154 so as to securely attach the applicator mounting apparatus 10' to the object 154 by the applying a compressive force thereto. In the illustrated embodiment of FIGS. 28 and 29, the generally flat object 154 with the solid surface may comprise, for example, the visor of an automobile.

Figure 30:
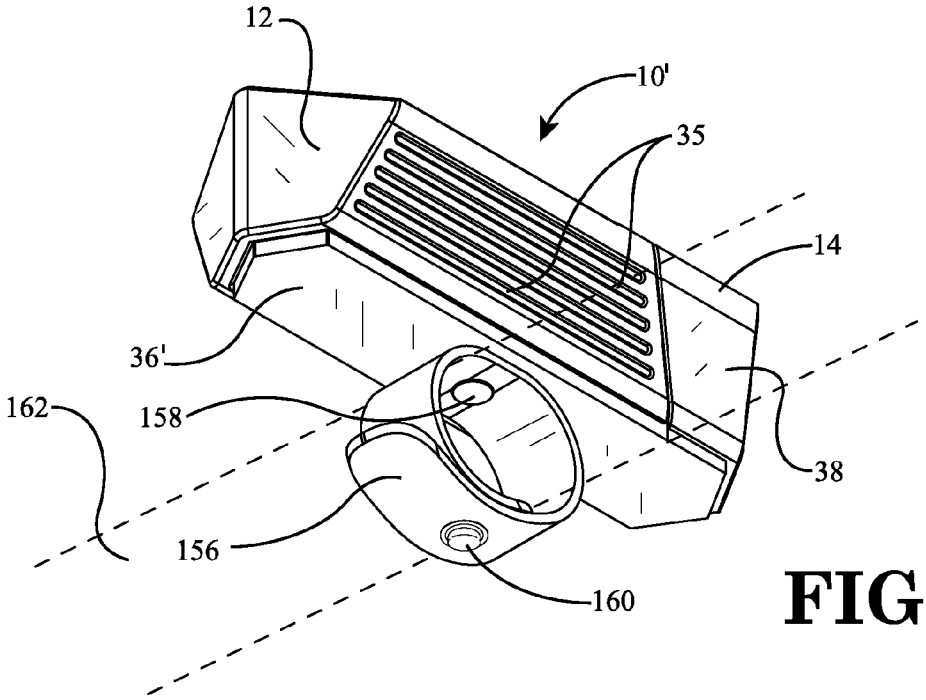
FIG. 30 is a rear-end perspective view illustrating an applicator mounting apparatus with a fourth alternative type of attachment means, according to yet another embodiment of the invention.
Figure 31:
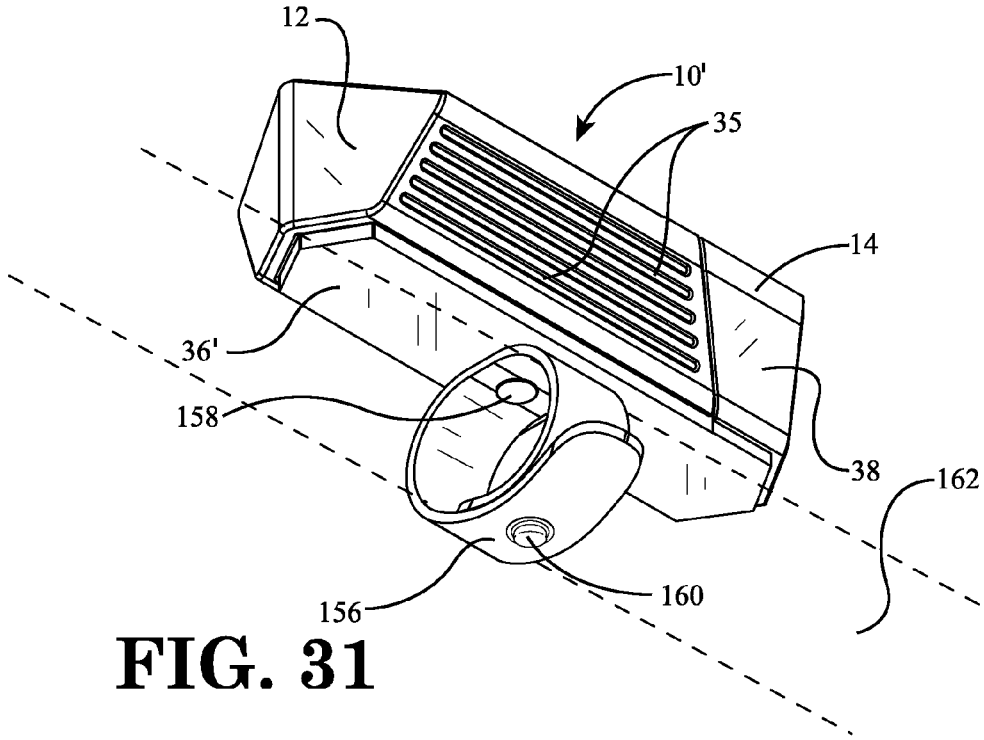
FIG. 31 is another rear-end perspective view illustrating the applicator mounting apparatus with the fourth alternative type of attachment means of FIG. 30, wherein the applicator mounting apparatus has been rotated about the band fastener such that it is in a different orientation angle.

In FIGS. 30 and 31, yet another type of attachment means by which the applicator mounting apparatus may be attached to an object is shown. In these figures, band-type attachment devices 156 are used for securely coupling the applicator mounting apparatus 10' to a generally elongate object 162. In particular, as shown in FIGS. 30 and 31, a band-type attachment device 156 may be affixed to the support member 36' of the mount 14 of the applicator mounting apparatus 10' by means of a securement fastener 158 passing through the band 156. For example, as shown in these figures, the securement fastener 158 may comprise a pin securing the attachment band 156 to the bottom surface of the support member 36'. Referring to FIGS. 30 and 31, the attachment band 156 is initially wrapped around a section of the elongate object 162, and then secured in place with a fastener 160 (e.g., a snap-type fastener) that attaches the free ends of the attachment band 156 together. Two different orientations of the applicator mounting apparatus 10' on the object 162 are depicted in FIGS. 30 and 31 in order to illustrate that the applicator mounting apparatus 10' is capable of being rotated about the securement fastener 158 (i.e., the securement fastener 158 operates as a pivot point about which the applicator mounting apparatus 10' is capable of being rotated). In the illustrated embodiment of FIGS. 30 and 31, the elongate object 162 may comprise, for example, the handle bar of a bicycle or a ski pole. In an alternative embodiment, rather than the free ends of the attachment band 156 being secured by a snap-type fastener 160, it is to be understood that a hook-and-loop type fastening device may be used to secure the free ends of the attachment band 156 to one another instead.

Figure 32:
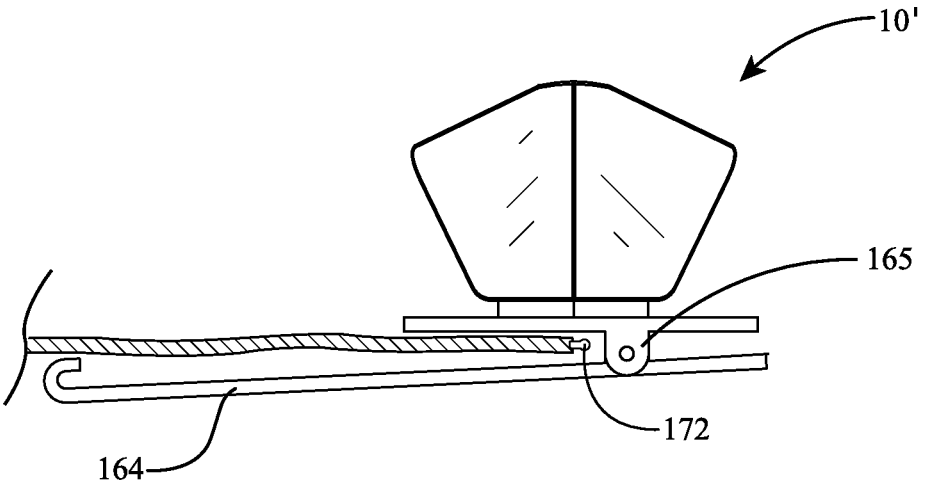
FIG. 32 is a top plan view illustrating an applicator mounting apparatus with a fifth alternative type of attachment means, according to still another embodiment of the invention.
Figure 33:
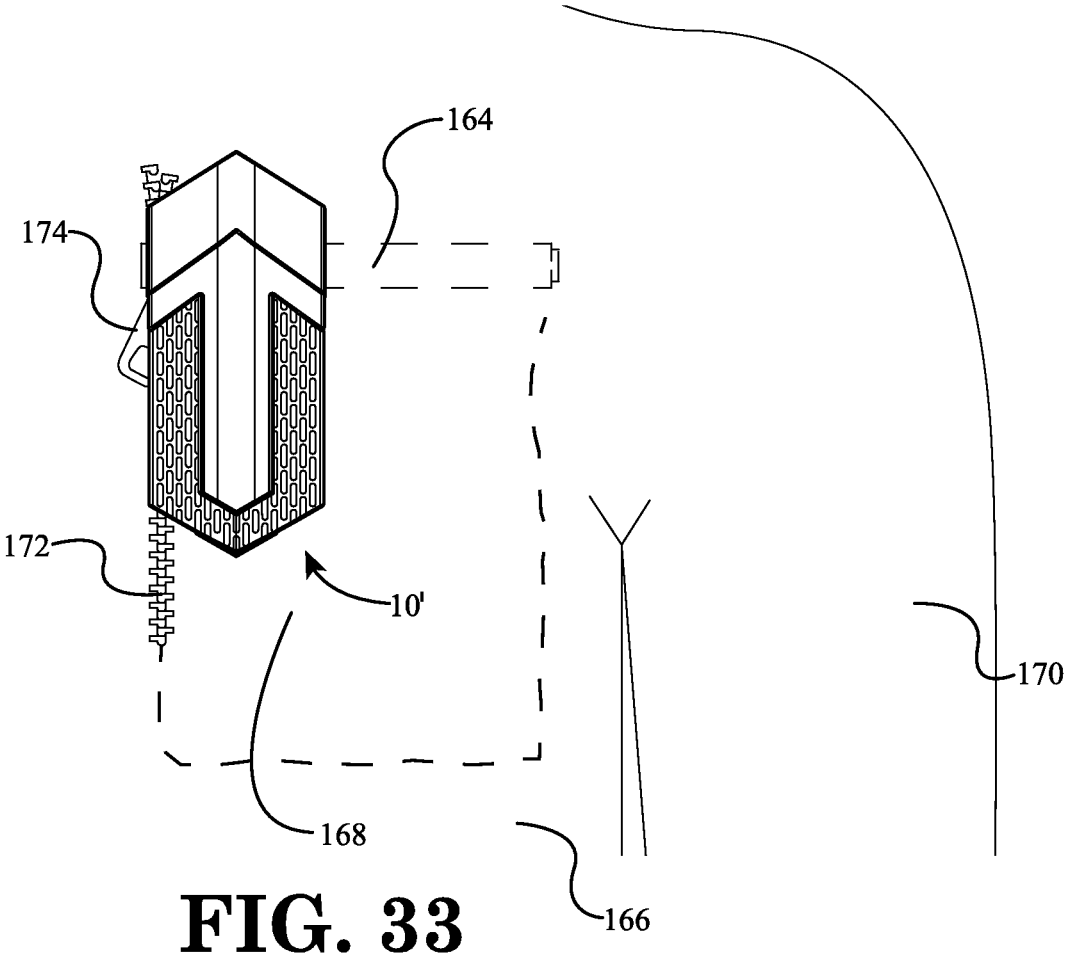
FIG. 33 is a front elevational view illustrating the applicator mounting apparatus with the fifth alternative type of attachment means of FIG. 32.

In FIGS. 32 and 33, still another type of attachment means by which the applicator mounting apparatus may be attached to an object is shown. In these figures, a spring clamp type attachment device 164 is used for securely coupling the applicator mounting apparatus 10' to a portion of an article of clothing. In particular, as shown in FIGS. 32 and 33, the spring clamp or spring clip 164 with hinge portion 165 may be used to secure the applicator mounting apparatus 10' to a zippered pocket 168 on a jacket 166 (e.g., a ski jacket) with jacket sleeves 170 (i.e., to clamp the applicator mounting apparatus 10' to the pocket 168). Initially, the pocket 168 of the jacket 166 is at least partially unzipped by a user using the zipper tab 174. After the pocket 168 is unzipped, the spring clamp or spring clip 164 is engaged with the zipper line 172 of the jacket 166, and a portion of the spring clamp or spring clip 164 is placed inside of the pocket 168 (see FIG. 33). As such, the spring clamp or spring clip 164 is capable of securely attaching the applicator mounting apparatus 10' to the jacket 166. As one example, the spring clamp mounting arrangement illustrated in FIGS. 32 and 33 is particularly useful for skiers who do not wear a ski helmet because it offers another alternative mounting location for the applicator mounting apparatus 10'.

Figure 34:
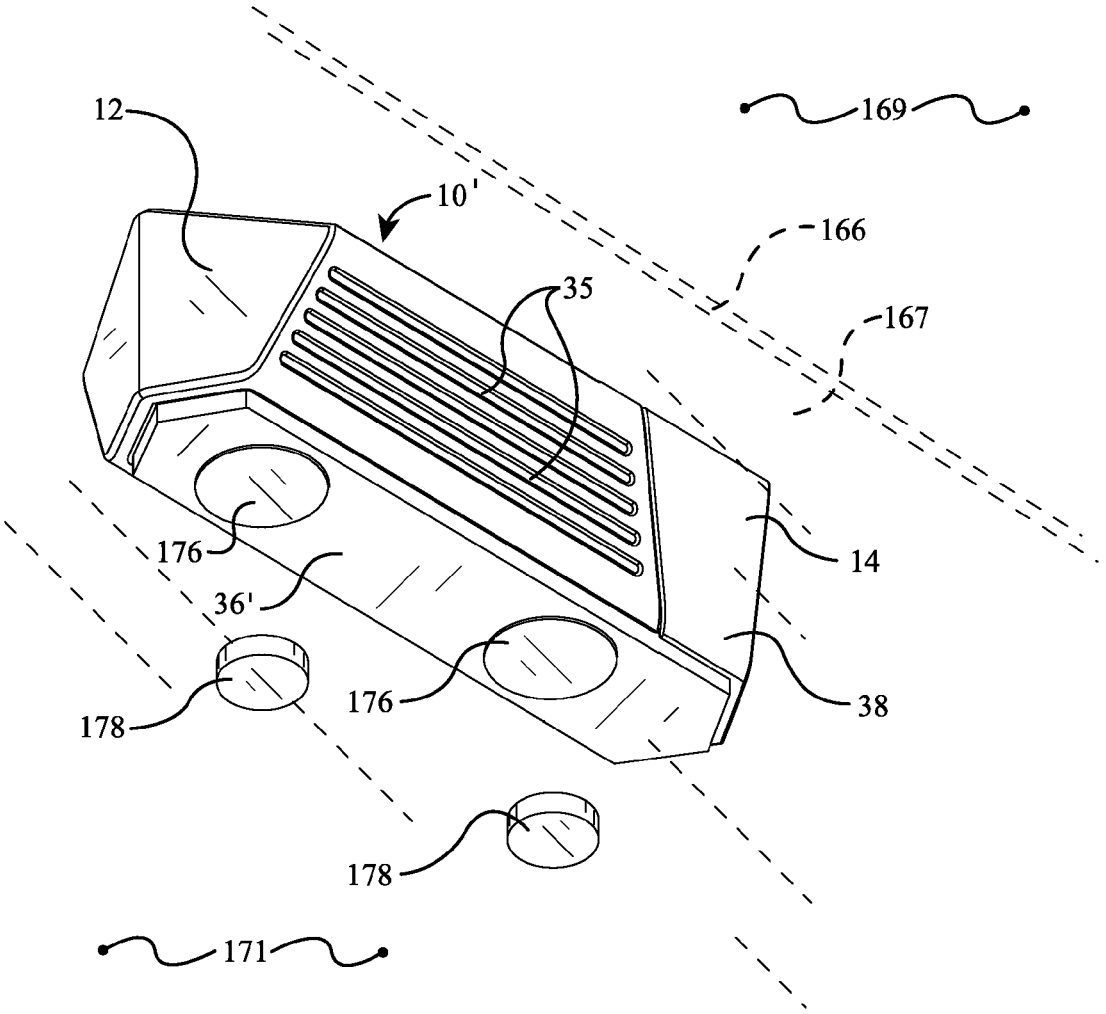
FIG. 34 is a rear-end perspective view illustrating an applicator mounting apparatus with a sixth alternative type of attachment means, according to yet another embodiment of the invention.

Referring to FIG. 34, yet another type of attachment means by which the applicator mounting apparatus may be attached to an object is shown. In this figure, a pair of metallic plates 176 and a corresponding pair of magnets 178 are used for securely coupling the applicator mounting apparatus 10' to a portion of an article of clothing. In particular, as shown in FIG. 34, a pair of circular metal plates 176 may be recessed mounted within the support member 36' of the mount 14 of the applicator mounting apparatus 10'. A pair of corresponding circular magnets 178, which are magnetically attracted to the circular metal plates 176, are used to sandwich the clothing fabric 167 between the support member 36' of the mount 14 and each of the magnets 178. In the mounting arrangement of FIG. 34, the applicator mounting apparatus 10' is disposed on the outside 169 of the article of clothing (e.g., a ski jacket 166) and the magnets 178 are disposed on the inside 171 of the article of clothing (e.g., inside the pocket of a ski jacket 166). Similar to that described above for the spring clamp or spring clip 164, as one example, the magnetic mounting arrangement illustrated in FIG. 34 is particularly useful for skiers who do not wear a ski helmet because it offers another alternative mounting location for the applicator mounting apparatus 10' (e.g., on the ski jacket 166 of the user). In an alternative embodiment, rather than the circular metal plates 176 being recessed mounted within the support member 36' of the mount 14, it is to be understood that magnets may be recessed mounted in the support member 36' so that the mount 14 could be easily attached to a metallic surface, such as the surface of a metal refrigerator.

Figure 35:
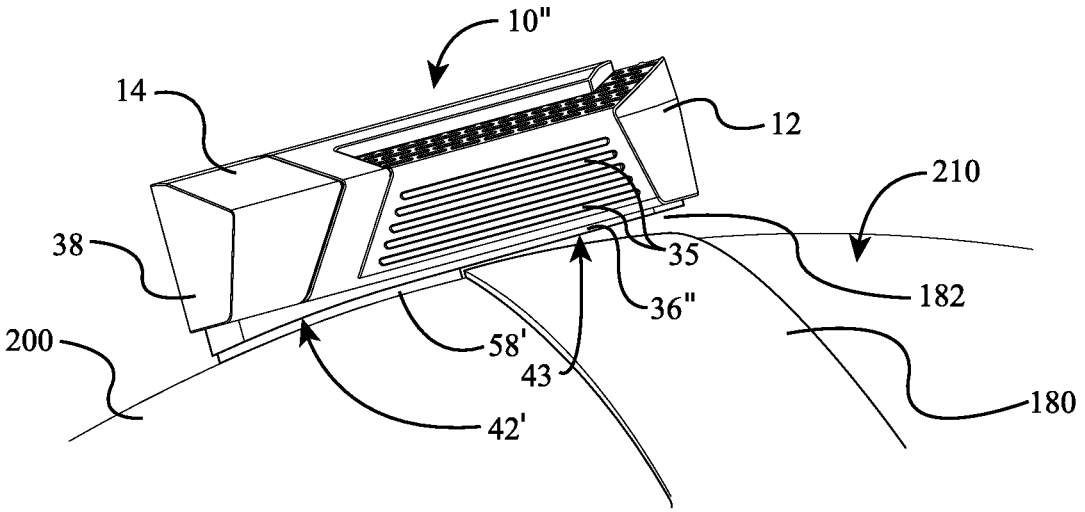
FIG. 35 is a side perspective view illustrating an applicator mounting apparatus with attachment means having a gap for accommodating a strap of goggles, according to still another embodiment of the invention.

Turning to FIG. 35, still another type of attachment means by which the applicator mounting apparatus may be attached to an object, such as a helmet 200, is shown. In particular, as depicted in FIG. 35, the mount 14 may be provided with a support member 36" having a curved bottom surface portion 42' and a generally flat bottom surface portion 43 with a gap 182 created thereunder, rather than the completely curved back surface 42 described above, so that the applicator mounting apparatus 10" may be mounted in a cantilevered-type mounting arrangement to accommodate a strap 180 passing over the surface 210 of the helmet 200 (e.g., a strap 180 of ski goggles). In FIG. 35, similar to the embodiments described above, it can be seen that a suitable adhesive strip 58' (e.g., 3M™ brand tape adhesive) may be used to secure the curved bottom surface portion 42' of the support member 36" of the mount 14 to the surface of the helmet 200. Advantageously, the cantilevered-type mounting arrangement of FIG. 35 creates a gap 182 disposed beneath the generally flat bottom surface portion 43 of the support member 36" of the mount 14 for accommodating the thickness of the strap 180 disposed on the surface 210 of the helmet 200. As such, as one example, the applicator mounting apparatus 10" may be readily used by a skier wearing both a helmet 200 and ski goggles.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. An applicator mounting apparatus for supporting an applicator from a mounting surface, said applicator mounting apparatus comprising:

a housing defining an applicator cavity for receiving at least a portion of an applicator therein, a side wall bounding said applicator cavity comprising an elongate slot formed therein so as to enable said side wall to flex when said applicator is inserted into said applicator cavity, said elongate slot being disposed along a length of said applicator cavity;

a mount engaging with said housing to contain said applicator, said mount configured to be coupled to a mounting surface, a portion of said mount configured to serve as a cap for said applicator, said mount further including a support member and an engagement member extending in a cantilevered manner from said support member, said support member configured to couple said mount to said mounting surface, and said engagement member forming said portion of said mount that is configured to serve as said cap for said applicator; and at least one coupling device releasably coupling said housing to said mount.

2. The applicator mounting apparatus according to claim 1, wherein at least one surface of said housing comprises a textured gripping pattern, knurling, protrusions, or indentations for enhancing a grip of a user on said housing.

3. The applicator mounting apparatus according to claim 1, wherein at least one surface of said housing comprises an aperture for enabling a user to gain access to a dispensing mechanism on said applicator without requiring said applicator to be removed from said housing.

4. The applicator mounting apparatus according to claim 1, wherein said support member of said mount is configured to matingly engage with a portion of said housing.

5. The applicator mounting apparatus according to claim 4, wherein said portion of said housing with which said support member of said mount matingly engages is an elongate groove formed in a surface of said housing.

6. The applicator mounting apparatus according to claim 1, wherein said engagement member of said mount comprises a cavity for receiving an end portion of said applicator, said cavity of said engagement member configured to substantially align with said applicator cavity of said housing when said housing is engaged with said mount.

7. The applicator mounting apparatus according to claim 1, wherein said engagement member of said mount comprises an interface surface, said interface surface of said engagement member configured to abut an end surface of said housing when said housing is engaged with said mount.

8. The applicator mounting apparatus according to claim 1, wherein said side wall bounding said applicator cavity comprises a pointed tip for preventing an exposed end of a substance disposed in said applicator from contacting a front surface of said support member when said housing is engaged with said mount.

9. The applicator mounting apparatus according to claim 1, wherein said at least one coupling device comprises at least one pair of coupling devices, a first of said at least one pair of coupling devices being disposed in or on said housing, and a second of said at least one pair of coupling devices being disposed in or on said mount.

10. The applicator mounting apparatus according to claim 1, wherein said at least one coupling device comprises one or more magnets.

11. The applicator mounting apparatus according to claim 1, wherein an interior surface of said side wall bounding said applicator cavity comprises an elongate protrusion disposed along a length of said applicator cavity for engaging a side of said applicator; and wherein an interior surface of an end wall bounding said applicator cavity comprises a conical projection for creating a gap between a dispensing mechanism of said applicator and said end wall of said applicator cavity so as to enable an uninhibited rotation of said dispensing mechanism.

12. An applicator system configured to be supported from a mounting surface, said applicator system comprising:

an applicator configured to dispense a substance for application on a body portion of a user or on an object; and an applicator mounting apparatus, which includes:

a housing defining an applicator cavity for receiving at least a portion of said applicator therein, a side wall bounding said applicator cavity comprising an elongate slot formed therein so as to enable said side wall to flex when said applicator is inserted into said applicator cavity, said elongate slot being disposed along a length of said applicator cavity;

a mount engaging with said housing to contain said applicator, said mount configured to be coupled to a mounting surface, a portion of said mount configured to serve as a cap for said applicator, said mount further including a support member and an engagement member extending in a cantilevered manner from said support member, said support member configured to couple said mount to said mounting surface, and said engagement member forming said portion of said mount that is configured to serve as said cap for said applicator; and at least one coupling device releasably coupling said housing to said mount.

13. The applicator system according to claim 12, wherein said substance that is configured to be dispensed by said applicator comprises one of: (i) lip balm, (ii) lip gloss, (iii) sunblock or sunscreen, (iv) deodorant, (v) hair spray, (vi) perfume, (vii) insect repellant, and (viii) glue stick.

14. The applicator system according to claim 12, wherein said engagement member of said mount comprises a cavity for receiving an end portion of said applicator, said cavity of said engagement member configured to substantially align with said applicator cavity of said housing when said housing is engaged with said mount.

15. The applicator system according to claim 14, wherein said at least one coupling device of said applicator mounting apparatus comprises at least one pair of coupling devices, a first of said at least one pair of coupling devices being disposed adjacent to said applicator cavity of said housing, and a second of said at least one pair of coupling devices being disposed adjacent to said cavity of said engagement member of said mount.

16. A method of using an applicator mounting apparatus, said method comprising the steps of:

(i) providing an applicator configured to dispense a substance for application on a body portion of a user or on an object, said applicator comprising an applicator body portion and an applicator cap removably engaged with said applicator body portion;

(ii) providing an applicator mounting apparatus for supporting said applicator from a mounting surface, said applicator mounting apparatus including:

a housing defining an applicator cavity for receiving at least a portion of said applicator therein, a side wall bounding said applicator cavity comprising an elongate slot formed therein so as to enable said side wall to flex when said applicator is inserted into said applicator cavity, said elongate slot being disposed along a length of said applicator cavity;

a mount engaging with said housing to contain said applicator, said mount configured to be coupled to said mounting surface, a portion of said mount configured to serve as a cap for said applicator, said mount further including a support member and an engagement member extending in a cantilevered manner from said support member, said support member configured to couple said mount to said mounting surface, and said engagement member forming said portion of said mount that is configured to serve as said cap for said applicator; and at least one coupling device releasably coupling said housing to said mount;

(iii) attaching said mount of said applicator mounting apparatus to said mounting surface;

(iv) inserting said applicator body portion of said applicator into said applicator cavity of said housing of said applicator mounting apparatus;

(v) removing said applicator cap from said applicator body portion of said applicator so as to expose an end portion of said applicator; and (vi) engaging said housing of said applicator mounting apparatus with said mount of said applicator mounting apparatus such that said engagement member of said mount serves as a cap for said end portion of said applicator.

17. The method according to claim 16, wherein said engagement member of said mount of said applicator mounting apparatus further comprises a cavity for receiving said end portion of said applicator, said cavity of said mount configured to substantially align with said applicator cavity of said housing when said housing is engaged with said mount; and wherein the step of (vi) engaging said housing of said applicator mounting apparatus with said mount further comprises inserting said end portion of said applicator into said cavity of said engagement member of said mount so as to cover said end portion of said applicator.

* * * * *